US005549997A

United States Patent [19]

Matsushima et al.

[11] Patent Number: 5,549,997

[45] Date of Patent: Aug. 27, 1996

[54] ELECTROPHOTOGRAPHIC PHOTORECEPTOR

[75] Inventors: Asao Matsushima; Takeo Ooshiba; Yoshihiko Etoh, all of Hachioji; Akira Kinoshita, Hino; Tomoko Suzuki, Hino; Tomoo Sakimura, Hino, all of Japan

[73] Assignee: Konica Corporation, Tokyo, Japan

[21] Appl. No.: 393,352

[22] Filed: Feb. 23, 1995

[30] Foreign Application Priority Data

| | | | |
|---|---|---|---|
| Feb. 28, 1994 | [JP] | Japan | 6-030140 |
| Mar. 17, 1994 | [JP] | Japan | 6-047239 |
| May 12, 1994 | [JP] | Japan | 6-098850 |

[51] Int. Cl.[6] ..... G03G 5/047; G03G 5/09

[52] U.S. Cl. ..... 430/59; 430/58; 430/83

[58] Field of Search ..... 430/58, 59, 83

[56] References Cited

U.S. PATENT DOCUMENTS

| | | | |
|---|---|---|---|
| 3,972,717 | 8/1976 | Wiedemann | 430/58 |
| 4,587,189 | 5/1986 | Hor et al. | 430/59 |
| 5,116,703 | 5/1992 | Badesha et al. | 430/130 X |
| 5,350,654 | 9/1994 | Pai et al. | 430/59 |

*Primary Examiner*—Roland Martin

*Attorney, Agent, or Firm*—Finnegan, Henderson, Farabow, Garrett & Dunner, L.L.P.

[57] ABSTRACT

Disclosed is an electrophotographic photoreceptor contains a carrier generation material represented by Formula 1 or 2 having peaks at 2θ=6.3°, 12.4°, 25.3° and 27.1° in the Bragg angle (2θ±0.2°) as measured by X-ray diffraction under radiation of Cu-Kα rays; said peak of 12.4° has a maximum intensity and has a half width of 0.65° or more; no peak being present at 11.5°; and a carrier transportation material selected from the group consisting of the following Formulas 3, 4, 5 and 6;

Formula 1:

Formula 2:

wherein Z represents an atomic group necessary to form a substituted or unsubstituted heterocyclic ring;

Formula 3:

Formula 4:

Formula 5:

(Abstract continued on next page.)

-continued
Formula 6:
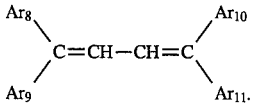
20 Claims, 11 Drawing Sheets

In a length of 18 on a sample, Rz is measured follows $$Rz = \frac{(R1 + R3 + R5 + R7 + R9) - (R2 + R4 + R6 + R8 + R10)}{5}$$

ELECTROPHOTOGRAPHIC PHOTORECEPTOR

FIELD OF THE INVENTION

The present invention relates to an electrophotographic photoreceptor. More particularly, it relates to a high-sensitive electrophotographic photoreceptor effectively usable in printers, copying machines and so forth.

BACKGROUND OF THE INVENTION

Electrophotographic photoreceptors used in electrophotographic systems can be roughly grouped into inorganic photoreceptors mainly composed of inorganic photoconductive materials such as selenium and cadmium sulfide and organic photoreceptors mainly composed of various organic photoconductive compounds. Hithertofore, the inorganic photoreceptors, having superior sensitivity characteristics, have been used in high-speed copying machines. Their use, however, has been greatly restricted because of the toxicity of production materials and product compounds. In recent years, also from the viewpoint of environmental protection, such inorganic photoreceptors are strongly demanded to be replaced by harmless organic photoreceptors. In accordance with such an inclination, there is a strong demand for making the performance of organic photoreceptors higher. In particular, technical development for achieving a higher sensitivity is now an urgent subject.

Methods most commonly used for the improvement of performance of organic photoreceptors is the technique of function separation in which the function of carrier generation and the function of carrier transportation are separately assigned to different materials. Since the carrier generation and the carrier transportation are shared by different materials, it has become possible to select materials respectively suited for them from a vast range of materials. In particular, the organic photoreceptors, for which many kinds of compounds are available, are advantageous for achieving a higher performance by such function separation, and many carrier generation materials and carrier transportation materials are proposed.

The carrier generation materials for the organic photoreceptors include, for example, polycyclic quinone compounds as typified by dibromoanthanthrone, phthalocyanine compounds such as metal-free phthalocyanine and titanyl phthalocyanine, bisazo compounds or trisazo compounds, eutectic complexes of thiapyrylium compounds with polycarbonate, and squalium compounds, which have been put into practical use. The carrier transportation materials include, for example, pyrazoline compounds, polyalkane compounds, triphenylamine compounds, hydrazone compounds, tetraphenylbenzidine compounds, which also have been put into practical use.

In particular, the sensitivity characteristics directly depends on the performance of carrier generation materials, where the basic function thereof, i.e., the ability to absorb incident light to produce electron carriers not only depends on the molecular structure of the carrier generation material, but also is greatly influenced by the form in which the molecules thereof aggregate. For example, many crystal forms are known in the case of the above metal-free phthalocyanine or titanyl phthalocyanine. Since a difference in crystal form even with the same molecular structure makes the quantum efficiency of carrier generation entirely different, there is seen a great difference in the electrophotographic sensitivity brought as a result. As well known, X-type crystals or τ-type crystals of metal-free phthalocyanine show a sensitivity greater by one order than α-type crystals or β-type crystals, and Y-type crystals of titanyl phthalocyanine shows a sensitivity greater by 3 to 4 times than A-type crystals or B-type crystals. Similarly, in the case of azo compounds and squalium compounds also, their sensitivities greatly change depending on differences in the structures of molecular aggregation.

Thus, in the further advancement of carrier generation materials, it is essential as factors to optimize their chemical structures and also to optimize the crystal structures or molecular aggregation structures.

A technique in which an imidazole perylene compound is used as a carrier generation material has been laid open in Japanese Patent Examined Publication No. 8423/1986 (U.S. Pat. No. 3,972,717). Since then, many electrophotographic photoreceptors making use of this compound as a carrier generation material have been studied. Japanese Patent Publication Open to Public Inspection (hereinafter referred to as Japanese Patent O.P.I. Publication) No. 59686/1984 discloses a technique in which the compound is coated in the form of a dispersion to produce a photoreceptor, and Japanese Patent O.P.I. Publications No. 275848/1986 (U.S. Pat. No. 4,587,189), No. 180956/1988, No. 291061/1988, No. 186363/1992 and No. 186364/1992 disclose techniques in which the compound is used in combination with a specific carrier transportation material. Japanese Patent O.P.I. Publication No. 56444/1989 and No. 204850/1992 disclose techniques in which the compound is formed into fine particles by acid paste treatment, and Japanese Patent Examined Publication No. 41054/1988 discloses a technique in which a perylene type compound including this compound is purified by sublimation when used.

The fact that the imidazole perylene compound has some crystal forms is already reported in J. Imag. Sci., Vol. 33, pp.151–159 (1989), which discloses their X-ray diffraction spectra. However, what is mentioned in this publication with regard to electrophotographic performance is only concerned with deposited pigments and is unclear as to the relationship between the crystal forms and the electrophotographic performance.

Japanese Patent O.P.I. Publications No. 249719/1993 and No. 281769/1993 also disclose methods by which the crystal forms of the imidazole perylene compound are controlled. In such techniques, however, the crystalline state is controlled by dry process pulverization. Since a strong shear is locally applied during such dry process pulverization, there is a problem in respect of un-uniform pulverization to cause a disadvantage that black dots tend to occur in electrophotographic images. Also, in the dry process pulverization, a great mechanical impact is applied to the crystal powder, and hence crystal imperfections tend to be included, consequently tending to cause a lowering of the ability of charge potential retention. Thus, no satisfactory crystal control techniques are still available for the imidazole perylene compound, and the performance of the compound has not been brought out. In addition, all that have been disclosed in the above concerns the definition of crystal forms of a powder having not been dispersed (i.e., before dispersion), and by no means refer to the crystal forms of pigments having been dispersed (i.e., after dispersion) that have a direct influence on the electrophotographic performance. As will be made clear in Examples set out later, studies made by the present invention have revealed that, when photosensitive layer coating solutions are prepared using such imidazole perylene compounds, the X-ray diffraction spectra of the photosensitive layer coating solutions undergo changes depending on, besides the crystal forms before dispersion, the types of solvents, the conditions for preparation of coating solutions, e.g., dispersion strength, and the chemical purity of pigments, and at the same time cause changes also in electrophotographic performance. The relation with electrophotographic performance can not be said to be satisfactory unless the crystal forms of photosensitive layer coating solutions are studied.

The first object of the present invention is to produce a high-sensitivity organic photoreceptor, and has been achieved by employing as the carrier generation material the imidazole perylene compound having the specific crystal form.

Meanwhile, the carrier transportation material used in combination with such a carrier generation material is also an important factor on which the performance of photoreceptors depends. Not to speak of sensitivity performance, the properties of photosensitive layers that are required when used in photoreceptors greatly change depending on the carrier transportation material. Japanese Patent O.P.I. Publications No. 249719/1993 and No. 281769/1993 disclose techniques in which a benzidine type carrier transportation material is used. However, photoreceptors produced by incorporating such a compound tend to cause microscopic fissures (herein called cracks) in photosensitive layers, and have the problem that faulty images due to cracks tend to appear.

The second object of the present invention is to produce a photoreceptor that can be free of cracks, and has been achieved by the selection of the specific carrier transportation material As a constituent of the photoreceptor of the present invention, the photoreceptor has the intermediate layer in addition to the carrier generation layer and the carrier transportation layer. The intermediate layer is positioned between the conductive support and the photosensitive layer (comprised of the carrier generation layer and the carrier transportation layer), and is formed to have the function, e.g., to bond the support and the photosensitive layer, to cover defects on the support, to prevent insulation failure of the photosensitive layer from being caused by a charging assembly and to prevent unwanted charges from being injected from the support, and is provided, for example, by forming on the support a layer comprised of a polymeric compound such as polyvinyl alcohol, ethyl cellulose, carboxymethyl cellulose, an ethylene/vinyl acetate copolymer or casein. At any event, there has been the problem that the surface potential of photoreceptors may change because of a high residual-potential and a change in electrical resistivity due to environmental variations.

The third object of the present invention is to produce a photoreceptor that can be free of faulty images such as fog and blank areas and also may cause less changes in electrophotographic performance against environmental variations, and such an object has been achieved by the selection of the specific materials for the intermediate layer.

One of essential factors of photoreceptors is the conductive support. There are defects such as scratches and irregularities on the surface of supports having been just injection molded. If the photosensitive layer is formed on such a surface, faulty images such as pin-holes and black dots tend to occur at the time of image formation. Accordingly, supports whose surfaces have been mirror finished by means of a diamond tool or the like have been widely used in conventional analog copying machines. However, in recent years, with a progress of electronic equipment, there is an increasing demand for printers and digital copying machines making use of semiconductor lasers as light sources. When photoreceptors employing the supports having been subjected to such mirror finishing are used in printers or copying machines, conspicuous interference fringes (moirè) tend to appear at halftone image portions.

The fourth object of the present invention is to produce a photoreceptor that may cause very less interference fringes even when laser beams are used, may cause no faulty images such as blank areas, black dots and density decrease and may cause less lowering of image quality and less deterioration of sensitivity even in its long-term use. Such an object of the present invention has been achieved by employing as the carrier generation material the imidazole perylene compound having the specific crystal form.

Electrophotographic photoreceptors have conventionally the constitution that a metal support made of, for example, aluminum, copper, brass, steel or stainless steel, or a plastic support on which a metal thin film of aluminum, palladium, gold or the like formed by lamination or deposition to impart conductivity, is provided thereon with a low-resistivity thin-film intermediate layer, and a photosensitive layer is provided on the intermediate layer.

The intermediate layer is formed to have the function, e.g., to bond the support and the photosensitive layer, to cover defects on the support, to prevent insulation failure of the photosensitive layer from being caused by a charging assembly and to prevent unwanted charges from being injected from the support, and is provided, for example, by forming on the support a layer comprised of a polymeric compound such as polyvinyl alcohol, ethyl cellulose, carboxymethyl cellulose, an ethylene/vinyl acetate copolymer or casein, but is still unsatisfactory.

If the intermediate layer is formed in a large thickness, carriers are hindered from being moved to the support side at the time of exposure to light to cause an increase in fog and a deterioration of image quality, and hence the intermediate layer is usually formed in a thin layer of 0.1 to 2 μm thick.

The formation of such a thin layer imposes a difficulty in operation on account of manufacture techniques, and it is difficult to carry out uniform operation, where support defects such as scratches, irregularities and dust on the support surface can not necessarily well covered to tend to faulty images such as streaks, pin-holes and black dots at the time of image formation.

Accordingly, it is common to use supports whose surfaces have been mirror finished by means of a diamond tool or the like.

When, however, the supports having been subjected to such surface treatment are used in copying machines, printers or the like making use of semiconductor lasers as light sources, the state of the support surface may affect images to tend to cause conspicuous interference fringes (moirè) at halftone image portions to greatly damage the images As a countermeasure for the moirè, it is well known to use a technique in which the surface roughness of the support surface is defined to prevent interference fringes from occurring.

If, however, the support whose surface is in a rough state is used as in the above countermeasure, the support surface has a poor cleanability compared with the mirror-finished support when the support is cleaned. Hence, aluminum cuttings, dust, dirt, cutting oil and so forth having not been completely removed by cleaning may remain on the surface. These may cause blank areas, black dots and density decrease, resulting in faulty images, when images are formed by development in copying machines and printers making use of semiconductor laser light sources.

SUMMARY OF THE INVENTION

An object of the present invention is to provide an electrophotographic photoreceptor having a high sensitivity and a superior image stability, that can be widely used in high-speed copying machines, printers and facsimile machines.

Another object of the present invention is to newly provide an electrophotographic photoreceptor that may cause very less interference fringes even when laser beam sources are used, may cause no problems of blank areas, black dots, density decrease and so forth and can promise a high productivity, and to produce an electrophotographic photoreceptor that may cause less problem on environmental pollution and may cause less lowering of image quality and less deterioration of sensitivity even in its long-term use.

The above objects of the present invention can be achieved by the invention constituted as described below.

Item 1. An electrophotographic photoreceptor comprises a carrier generation material represented by Formula 1 or 2 having peaks at 2θ=6.3°, 12.4°, 25.3° and 27.1° in the Bragg angle (2θ±0.2°) as measured by X-ray diffraction under radiation of Cu-Kα rays; said peak of 12.4° has a maximum intensity and has a half width of 0.65° or more; no peak being present at 11.5°; and a carrier transportation material selected from the group consisting of the following Formulas 3, 4, 5 and 6;

Formula 1:

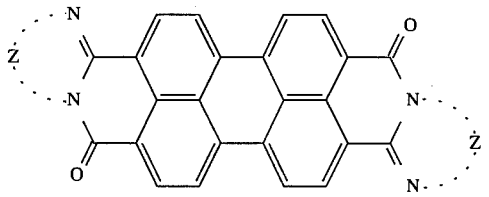

Formula 2:

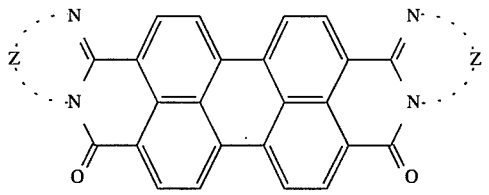

wherein Z represents an atomic group necessary to form a substituted or unsubstituted heterocyclic ring;

Formula 3:

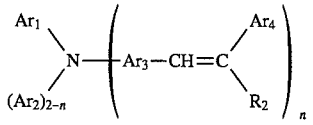

wherein $Ar_1$, $Ar_2$, $Ar_3$ and $Ar_4$ each represent a substituted or unsubstituted aromatic hydrocarbon group or heterocyclic group; R2 represents a hydrogen atom or a substituted or unsubstituted aromatic hydrocarbon group or heterocyclic group; n is 1 or 2; and $Ar_4$ and $R_2$ may combine each other;

Formula 4:

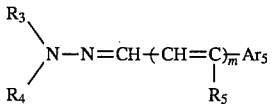

wherein $R_3$ and $R_4$ each represent a substituted or unsubstituted aromatic hydrocarbon group, heterocyclic group or alkyl group, which may combine one another; $R_5$ represent a hydrogen atom or a substituted or unsubstituted aromatic hydrocarbon group, heterocyclic group or alkyl group; $Ar_5$ represents a substituted or unsubstituted aromatic hydrocarbon group or heterocyclic group; and m is 0 or 1;

Formula 5:

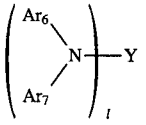

wherein Y represents a substituted or unsubstituted benzene, naphthalene, pyrene, fluorene, carbazole or 4,4'-alkylidene diphenyl group; $Ar_6$ and $Ar_7$ each represent a substituted or unsubstituted aromatic hydrocarbon group or heterocyclic group; and l is 1 to 3;

Formula 6:

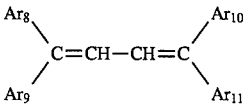

wherein $Ar_8$, $Ar_9$, $Ar_{10}$ and $Ar_{11}$ each represent a substituted or unsubstituted aromatic hydrocarbon group or heterocyclic group.

Item 2. The electrophotographic photoreceptor of item 1, wherein said carrier generation material is a compound represented by the following structure formula 1 or 2:

Structural formula 1

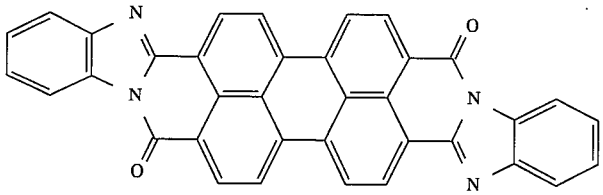

Structural formula 2

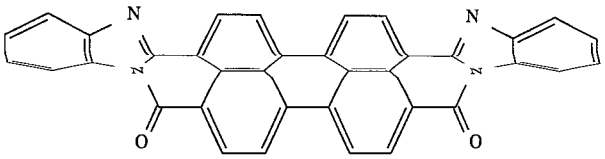

Item 3. An electrophotographic photoreceptor comprising a conductive support and provided thereon an intermediate layer, a carrier generation layer and a carrier transportation layer, wherein said carrier generation layer contains a carrier generation material comprising a perylene pigment represented by Formula 1 or 2; said perylene pigment has peaks at 2θ=6.3°, 12.4°, 25.3° and 27.1° in the Bragg angle (2θ±0.2°) as measured by X-ray diffraction under radiation of Cu-Kα rays; said peak of 12.4° has a maximum intensity and has a half width of 0.65° or more; no peak being present at 11.5°; and said carrier transportation layer contains a carrier transportation material selected from the group consisting of the following Formulas 3, 4, 5 and 6;

Formula 1:

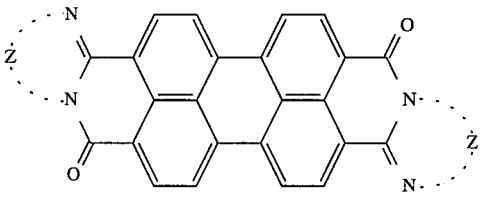

Formula 2:

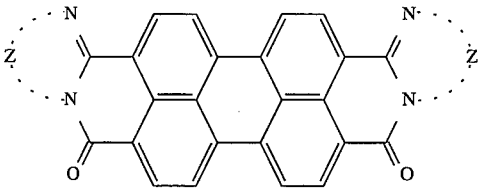

wherein z represents an atomic group necessary to form a substituted or unsubstituted heterocyclic ring;

Formula 3:

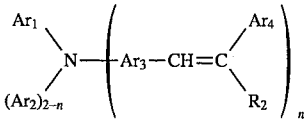

wherein $Ar_1$, $Ar_2$, $Ar_3$ and $Ar_4$ each represent a substituted or unsubstituted aromatic hydrocarbon group or heterocyclic group; R2 represents a hydrogen atom or a substituted or unsubstituted aromatic hydrocarbon group or heterocyclic group; n is 1 or 2; and $Ar_4$ and $R_2$ may combine each other;

Formula 4:

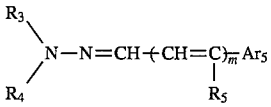

wherein $R_3$ and $R_4$ each represent a substituted or unsubstituted aromatic hydrocarbon group, heterocyclic group or alkyl group, which may combine one another; $R_5$ represent a hydrogen atom or a substituted or unsubstituted aromatic hydrocarbon group, heterocyclic group or alkyl group; $Ar_5$ represents a substituted or unsubstituted aromatic hydrocarbon group or heterocyclic group; and m is 0 or 1;

Formula 5:

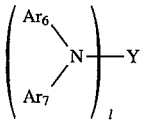

wherein Y represents a substituted or unsubstituted benzene, naphthalene, pyrene, fluorene, carbazole or 4,4'-alkylidene diphenyl group; $Ar_6$ and $Ar_7$ each represent a substituted or unsubstituted aromatic hydrocarbon group or heterocyclic group; and l is 1 to 3;

Formula 6:

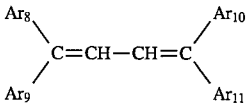

wherein $Ar_8$, $Ar_9$, $Ar_{10}$ and $Ar_{11}$ each represent a substituted or unsubstituted aromatic hydrocarbon group or heterocyclic group.

Item 4. The electrophotographic photoreceptor of item 3, wherein said perylene pigment is a compound represented by the following structure formula 1 or 2:

Structural formula 1

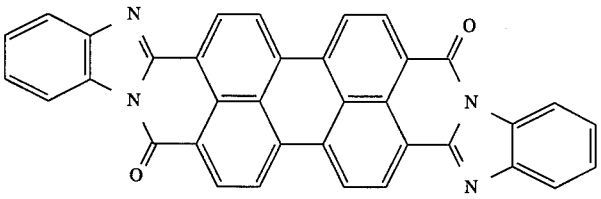

Structural formula 2

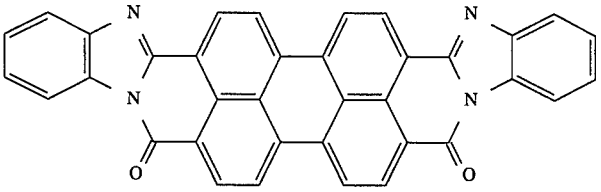

Item 5. The electrophotographic photoreceptor of item 3, wherein said perylene pigment is a compound by represented the following structural formula 1 or 2, and said carrier transportation material is a compound represented by said Structural formula 1

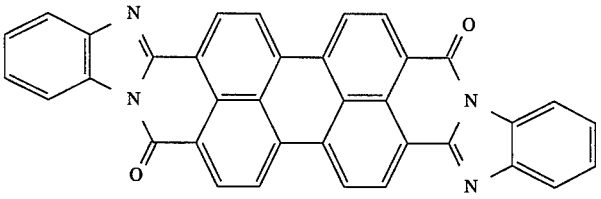

Structural formula 2

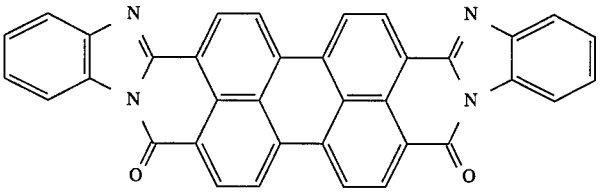

Item 6. The electrophotographic photoreceptor of item 3, wherein said perylene pigment is a compound represented by a structural formula 1 or 2, and said carrier transportation material is a compound represented by said Formula 4:

Structural formula 1

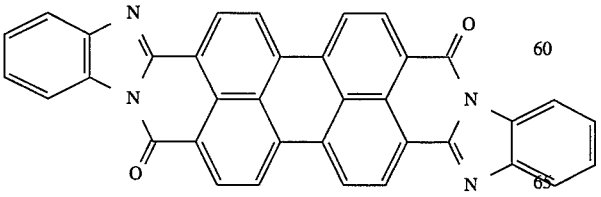

-continued

Structural formula 2

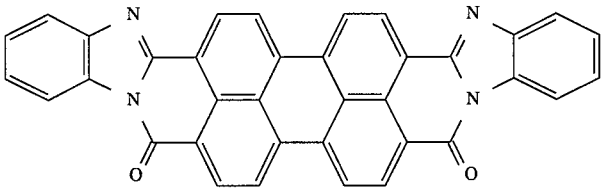

Item 7. The electrophotographic photoreceptor of item 3, wherein said perylene pigment is a compound represented by the structural formula 1 or 2, and said carrier transportation material is a compound represented by said Formula 5:

Structural formula 1

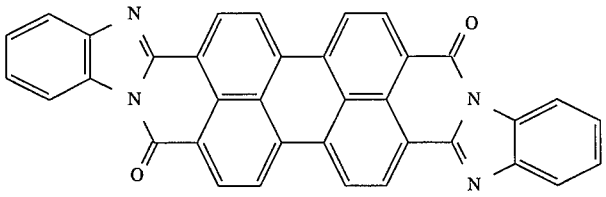

Structural formula 2

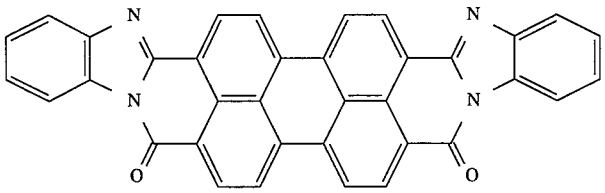

Item 8. The electrophotographic photoreceptor of item 3, wherein said perylene pigment is a compound represented by the following structural formula 1 or 2, and said carrier transportation material is a compound represented by said Formula 6:

Structural formula 1

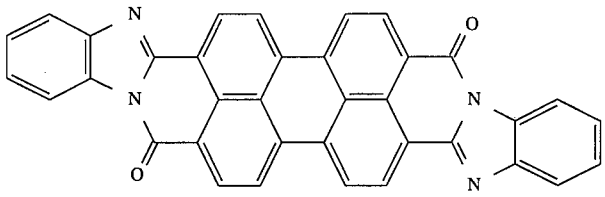

Structural formula 2

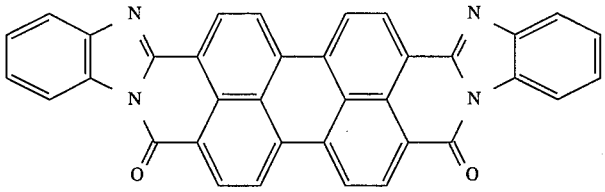

Item 9. The electrophotographic photoreceptor of item 3, wherein said perylene pigment is purified by sublimation purification and is treated with acid paste treatment.

Item 10. The electrophotographic photoreceptor of item 3, wherein said conductive support is provided thereon said intermediate layer, said carrier generation layer and said carrier transportation layer in this order; said intermediate layer contains an alcohol-soluble polyamide resin, and said carrier generation layer is formed by using a dispersion comprising said perylene pigment, a polymeric binder resin and an organic solvent.

Item 11. The electrophotographic photoreceptor of item 10, wherein said organic solvent is a ketone type solvent and said polymeric binder resin is a polyvinyl butyral resin.

Item 12. The electrophotographic photoreceptor of item 3, wherein said conductive support has a rough surface, and provided thereon said intermediate layer, said carrier generation layer and said carrier transportation layer in this order; said conductive support comprises an aluminum base material having a base material surface roughness, wherein a parallel line depth Rp is within the range of 0.11 μm to 0.8 μm and a maximum height of a roughness curve Rmax is within the range of 0.2 μm to 1.6 μm.

Item 13. The electrophotographic photoreceptor of item 12, wherein said intermediate layer comprising polyamide resin, is provided between said conductive support and said carrier generation layer.

Item 14. The electrophotographic photoreceptor of item 3, wherein said conductive support has a ten-point average surface roughness Rz of not less than 0.20 μm and not more than 1.50 μm.

Item 15. The electrophotographic photoreceptor of item 14, wherein an intermediate layer comprising a polyamide resin is provided between said conductive support and said carrier generation layer.

Figure 1:
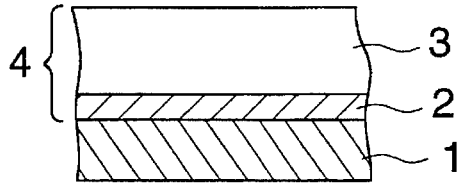
FIGS. 1(*a*) to 1(*f*) illustrate layer configurations of photoreceptors according to the present invention.
Figure 1:
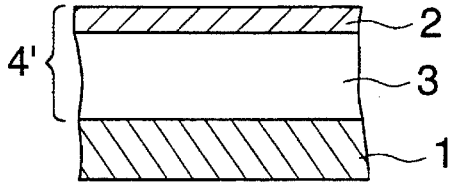
Figure 1:
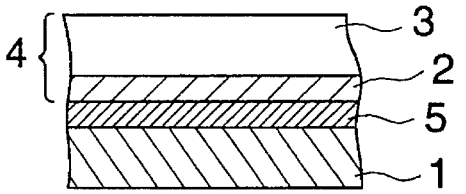
Figure 1:
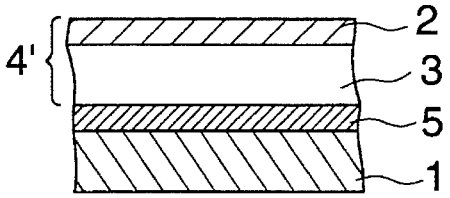
Figure 1:
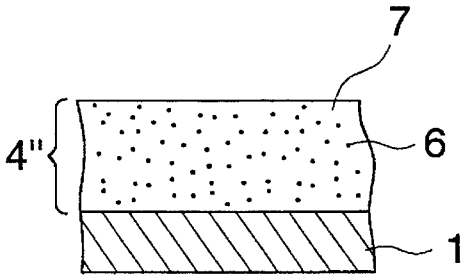
Figure 1:
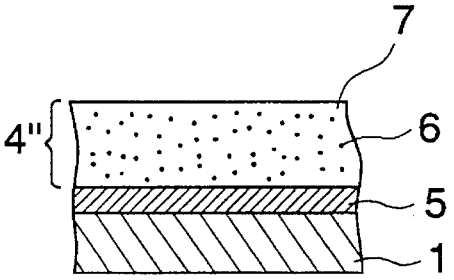

In the drawings, reference numerals denote as follows:

1: Conductive support
2: Carrier generation layer
3: Carrier transportation layer
4,4',4": Photosensitive layer
5: Intermediate layer
6: Carrier generation material
7: Carrier transportation material
16: Surface roughness (μm)
17: Average line X
8,18: Standard length L
9,19: Direction of record
10: Rmax
11: Rp
12: Rv

DETAILED DESCRIPTION OF THE INVENTION

The present invention will be described below in detail.

The electrophotographic photoreceptor of the present invention contains at least, as a carrier generation material, the perylene compound represented by Formula 1 or 2.

In Formula 1 or 2, as a preferred constituent of the heterocyclic ring represented by Z, it may include, for example, a benzene ring, a naphthalene ring, an anthracene ring, a phenanthrene ring, a pyridine ring, a pyrimidine ring a pyrazole ring and an anthraquinone ring which are divalent. In particular, Z may preferably be a benzene ring or a naphthane ring. Z may also have a substituent, and the substituent may include an alkyl group, an alkoxy group, an aryl group, an aryloxy group, an acyl group, an acyloxy group, an amino group, a carbamoyl group, a halogen atom, a nitro group and a cyano group.

Examples of the perylene compound preferably used in the present invention are shown below, which by no means limit the present invention.

| Exemplary compounds No. | Z | Exemplary compounds No. | Z |
|---|---|---|---|
| A-1 | 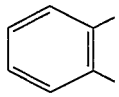 | A-12 | 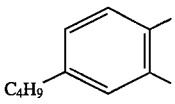  |
| A-2 | 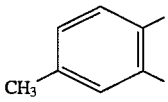  | A-13 | 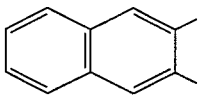 |

-continued

| Exemplary compounds No. | Z | Exemplary compounds No. | Z |
|---|---|---|---|
| A-3 | 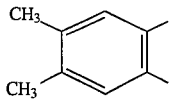 | A-14 | 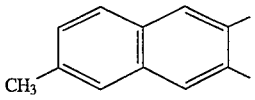 |
| A-4 | 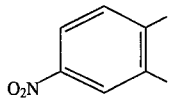 | A-15 | 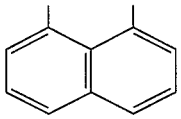 |
| A-5 | 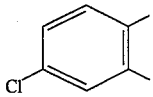 | A-16 | 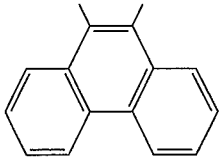 |
| A-6 | 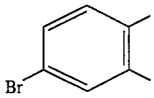 | A-17 | 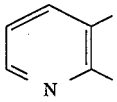 |
| A-7 | 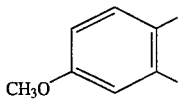 | A-18 | 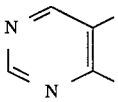 |
| A-8 | 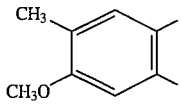 | A-19 | 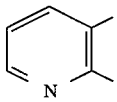 |
| A-9 | 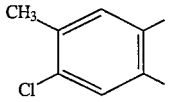 | A-20 | 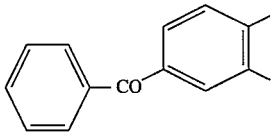 |
| A-10 | 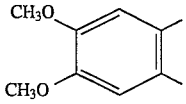 | A-21 | 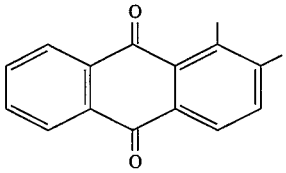 |
| A-11 | 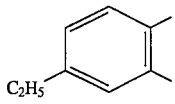 | | |

These exemplary compounds can be synthesized by the process disclosed in, for example, Japanese Patent O.P.I. Publications No. 128734/1974 and No. 569686/1984.

In general, in order to obtain high-sensitivity photoreceptor characteristics, it is firstly necessary to obtain a uniform coating film in which a carrier generation material has been made into fine particles. More specifically, what is first important in the step of dispersion to produce fine particles is to make the carrier generation material into fine particles. However, as a result of the studies made by the present inventors, in addition to the sensitization effect obtained when the compound is made into fine particles, the perylene compound of Formula 1 or 2 of the present invention may undergo a physical damage in the insides or on the surfaces of crystals because of a strong shear force applied to pulverize particles, depending on the manner of making it into fine particles, and may cause a desensitization effect, so that its sensitivity characteristics tend to greatly lower on the contrary. Now, it is preferable in the course of pulverization to make the pigment into fine particles under a shear force as small as possible. In the present invention, it is preferable to carry out acid paste treatment and to use a pigment having small particle diameters and also having a uniform particle size.

With regard to the crystal form of the imidazole perylene compound used in the present invention, J. Imag. Sci., Vol. 33, pp.151–159 (1989) discloses four kinds of X-ray diffraction spectra, called α-, γ-, ε- and ρ-forms. The α-form and the ε-form have basically an analogous crystal structure, but it is apparent that the ρ-form crystals are quite different from the formers. In the present invention, the crystalline state is based on this ρ-form crystals. A little change in crystalline state that occurs in the course where this ρ-form crystals are dispersed and made into fine particles in an organic solvent has a remarkable influence on the sensitivity characteristics.

When the particles are dispersed and made into fine particles and consequently their particle size becomes smaller than a certain size, a broadening of diffraction and a lowering of peak intensity occur in X-ray diffraction spectra. The ρ-form crystals of the imidazole perylene compound is characteristic of having peaks at 6.3°±0.2°, 12.4°±0.2°, 25.3°±0.2° and 27.1°±0.2° as measured by X-ray diffraction under radiation of Cu-Kα rays. Besides, a specific peak is present at 11.5°±0.2°. As the ρ-form crystals are dispersed and made finer, a broadening of the whole peaks can be seen. What is important in the present invention is that the peak at 12.4°±0.2° has a half width of 0.65° or more. In order for the compound to exhibit good properties as a carrier generation material of the photoreceptor, the peak at 12.4°±0.2° having thus undergone the broadening must bury the peak at 11.5°±0.2° so that no peak is seen in the region of 11.5°±0.2°. However, if the peak at 12.4°±0.2° has a half width of 1.5° or more, the crystals can be no longer said to be in the state of the ρ-form crystals, resulting in a deterioration of characteristics.

The photoreceptor characteristics of the perylene compound of the present invention depends on the crystalline state characterized by the relative intensities of peaks in the X-ray diffraction spectrum. Most of perylene compounds show a maximum peak intensity at around 6.3° at the stage where they have been synthesized. When they are purified by sublimation, some compounds show a maximum peak intensity at 25° to 28°, and some compounds show a maximum peak intensity at 12.4°. When, however, they are dispersed and made into fine particles in an organic solvent, the relative intensities of the respective peaks undergo changes, and accordingly the photoreceptor characteristics undergo changes. In the crystals of the present invention, particularly superior sensitivity characteristics can be obtained when they are made to show a maximum peak intensity at 12.4°±0.2° of the X-ray diffraction spectrum.

More specifically, in the present invention, the ρ-form crystals are made into fine particles up to the state that their peak at 12.4°±0.2° has a half width of 0.65° or more and they show no peak at 11.5°±0.2°, and also used in the state that they show a maximum peak intensity at 12.4°±0.2°. In the present invention, what is meant by "show no peak" is that the crystal show the peak intensity is less than 1/100 with respect to the maximum peak intensity.

There are no particular limitations on methods for obtaining such a crystalline state of the carrier generation material. A best method for preventing the faulty electrophotographic images as seen in the dry process pulverization is a method in which a perylene compound purified by sublimation is treated with acid paste treatment (to make amorphous or low-crystalline) by the use of sulfuric acid and water, and the treated compound is gently dispersed in an organic solvent having a high affinity in the presence of a polymer binder to effect crystal growth so as to be brought into the preferable crystalline state. In this method, the compound can be formed into uniform fine particles, and also, because of a small mechanical impact, characteristics can be prevented from lowering because of inclusion of crystal imperfections.

The imidazole perylene compound included in Formula 1 or 2 can be synthesized by dehydration condensation reaction of perylene-3,4,9,10-tetracarboxylic acid dianhydride with o-phenylenediamine.

The imidazole perylene compound thus synthesized is purified by sublimation. The sublimation may be operated at least once, or repeatedly within the range of 5 to 6 times. It may preferably be repeatedly operated twice or more. If a coating solution is prepared without the sublimation purification, it is difficult to obtain the crystalline state as intended in the present invention. The imidazole perylene compound obtained after sublimation shows a sharp peak pattern in the X-ray diffraction spectrum, and is confirmed to be in the state of a high degree of crystallization.

The imidazole perylene compound with a high degree of crystallization, obtained by the sublimation purification, is converted into the state of a low degree of crystallization by the acid paste treatment. More specifically, after the compound is dissolved in a concentrated sulfuric acid, the resulting solution is poured in water or a poor solvent such as methanol to carry out precipitation, and the precipitate is filtered, followed by drying to obtain a fine particle powder with a low crystalline structure.

The fine particle powder which is a low crystalline powder having been treated with the acid paste treatment is dispersed in a solvent having a high affinity for the imidazole perylene compound, using a suitable dispersion machine. As the solvent having a high affinity, ketone type solvents having 4 through 8 carbon atoms, cyclic ether type solvents having 4 through 7 carbon atoms or halogenated hydrocarbon type solvents having 2 through 4 carbon atoms are preferably employed. Among these, particularly preferable solvents are methyl ethyl ketone, methyl isopropyl ketone, methyl isobutyl ketone, cyclohexanone, tetrahydrofuran, dichloroethane and trichloroethane. In this dispersion treatment, the presence of a suitable binder polymer can bring about good results.

Such a binder polymer may particularly preferably include polyvinyl acetal resins such as polyvinyl butyral and polyvinyl formal, vinyl chloride/vinyl acetate type resins, polyester resins, polycarbonate resins, acrylic resins and methacrylic resins, acrylic and methacrylic copolymer resins, silicone resins, silicone copolymer resins, polystyrene, styrene copolymer resins, phenoxy resins, phenol resins, urethane resins, and epoxy resins.

In the dispersed coating solution obtained by such a method, the specific crystalline state of the present invention is achieved. In this method, the high purity carried out by the sublimation process is important for controlling the crystalline state at the time of dispersion. The compound thus purified is turned amorphous by the acid paste treatment, and in the course of the dispersion treatment the compound in an amorphous state (or in a low-crystalline state) is brought to undergo the specific solvent effect to carry out crystal growth. Through this procedure, the specific crystalline state of the present invention is stably obtained.

The photoreceptor is produced using the dispersed coating solution thus obtained. The crystalline state of the present invention has been achieved in the photoreceptor can be ascertained by measuring X-ray diffraction spectra of perylene compounds separated from the photoreceptor. In the course of the coating to produce the photoreceptor, no changes occur in the crystalline state, and hence the crystalline state can also be ascertained by measuring X-ray diffraction spectra of the dispersed coating solution from which the solvent has been removed.

On the sample thus obtained, measurement is made by means of a powder X-ray diffraction apparatus using Cu-kα rays as an X-ray source. Thus, a diffracted beam intensity distribution is obtained as function of the Bragg angle 2θ. Here, if the sample is in an enough quantity, the relative intensity ratio between peak intensities does not change depending on the quantity of the sample. However, with a decrease in the quantity of the sample, peak intensities on the side of low angles become relatively larger. Hence, in the measurement, the sample must be used in a quantity large enough to cause no changes depending on the quantity of the sample.

Figure 2:
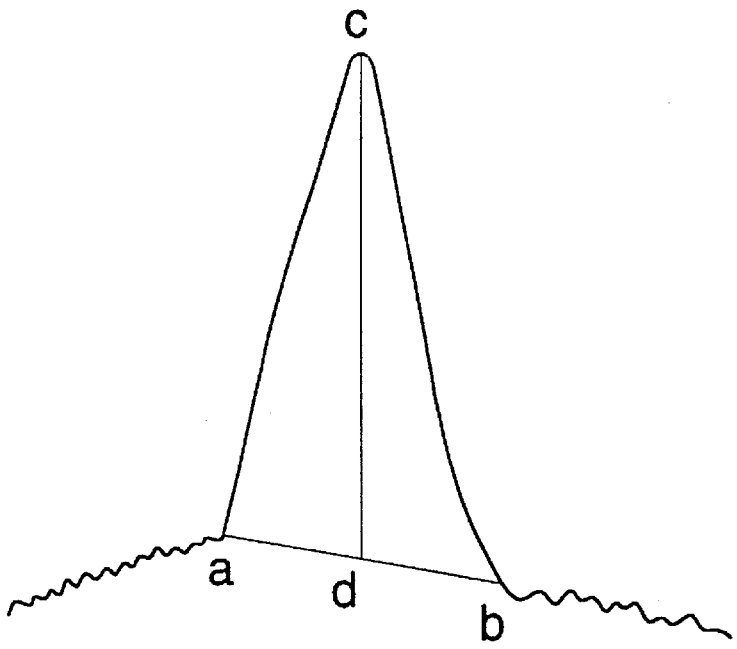
FIGS. 2(*a*) and 2(*b*) show the definition of peak intensity and half width in X-ray diffraction peaks.
Figure 2:
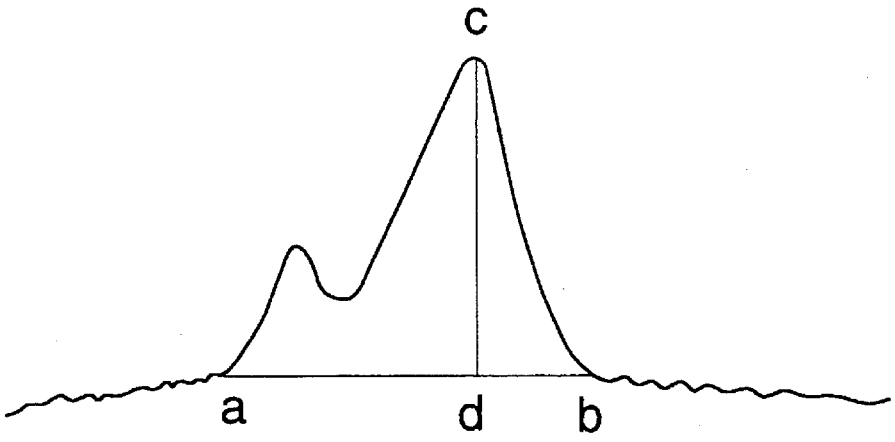

The peak intensity measured here is defined as follows: As shown in FIG. 2, a point d at which a segment of a line that connects points a and b rising from a base line level containing a noise intersects a perpendicular line dropped from a vertex c is regarded as the starting point, and the peak intensity is defined to be a height from the point d up to the vertex c (the length of a segment cd). The half width of the peak is defined to be a peak width at the position of cd/2 high from the point d.

In the present invention, a photoreceptor having superior sensitivity characteristics and image stability can be obtained when at least one of the compounds represented by Formulas 3, 4, 5 and 6 is used as the carrier transportation material. In particular, especially high sensitivity characteristics can be obtained when the carrier transportation material represented by Formula 3 is used.

Formula 3:

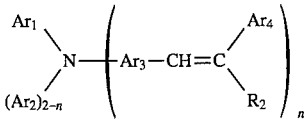

In the formula, $Ar_1$, $Ar_2$, $Ar_3$ and $Ar_4$ each represent a substituted or unsubstituted aromatic hydrocarbon group or heterocyclic group, and $R_2$ represents a hydrogen atom or a substituted or unsubstituted aromatic hydrocarbon group or heterocyclic group. n represents 1 or 2. The aromatic hydrocarbon group or heterocyclic ring may preferably include benzene, naphthalene, anthracene, thiophene, pyridine and carbazole. Benzene and naphthalene are particularly preferred. The substituent on the aromatic hydrocarbon group or heterocyclic ring may include an alkyl group, an aryl group, an alkoxy group, an aryloxy group, an acyl group, an acyloxy group, a halogen atom, an amino and a cyano group. Particularly preferred are an alkyl having 1 to 6 carbon atoms, an alkoxy group having 1 to 6 carbon atoms, an acyl group having 1 to 6 carbon atoms, a halogen atom, and an amino group. $Ar_4$ and $R_2$ may combine each other.

Formula 4:

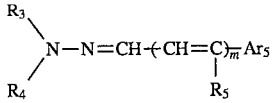

In the formula, $R_3$ and $R_4$ each represent a substituted or unsubstituted aromatic hydrocarbon group, heterocyclic group or alkyl group; $R_5$ represent a hydrogen atom or a substituted or unsubstituted aromatic hydrocarbon group, heterocyclic group or alkyl group; and $Ar_5$ represents a substituted or unsubstituted aromatic hydrocarbon group or heterocyclic group. m represents 0 or 1. $R_3$ and $R_4$ are preferably be those including a methyl group, an ethyl group, a phenyl group, a naphthyl group and a thienylmethyl group. $R_5$ may preferably be a hydrogen atom or a phenyl group. $Ar_5$ may preferably be benzene, naphthalene, pyrene, thiophene, pyridine or carbazole, and particularly preferably be benzene, pyrene or carbazole. The substituent of $Ar_5$ may preferably be an alkyl group having 1 to 6 carbon atoms, a dialkyl amino group or a diaryl amino group.

Formula 5:

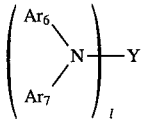

In the formula, Y represents a substituted or unsubstituted benzene, naphthalene, pyrene, fluorene, carbazole or 4,4'-alkylidene diphenyl group. $Ar_6$ and $Ar_7$ each represent a substituted or unsubstituted aromatic hydrocarbon group or heterocyclic group. l represents 1 to 3.

The substituent on Y may preferably be an alkyl group having 1 to 6 carbon atoms. $Ar_6$ and $Ar_7$ may preferably be benzene, and the substituent may preferably be an alkyl group having 1 to 6 carbon atoms, an aryl group, an alkoxy group or an aryloxy group.

Formula 6:

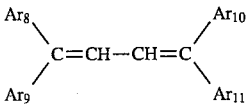

In the formula, $Ar_8$, $Ar_9$, $Ar_{10}$ and $Ar_{11}$ each represent a substituted or unsubstituted aromatic hydrocarbon group or a substituted or unsubstituted heterocyclic group, and benzene is particularly preferred. The substituent thereof may preferably be dialkylamine or diarylamine.

Examples of the carrier transportation materials represented by Formulas 3, 4, 5 and 6 are shown below.

Formula 3:
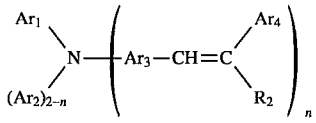
| | $Ar_1$ | $Ar_2$ | $Ar_3$ | $Ar_4$ | $R_2$ | n |
|---|---|---|---|---|---|---|
| B-1 | 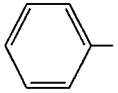 | 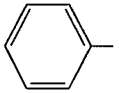 | 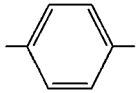 | 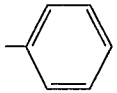 | H | 1 |
| B-2 | 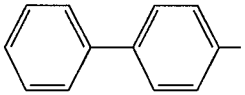 | 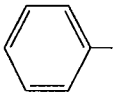 | 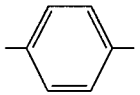 | 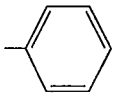 | H | 1 |
| B-3 | 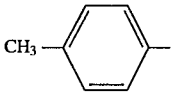 | 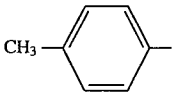 | 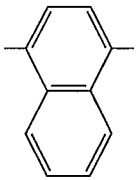 | 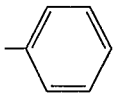 | H | 1 |
| B-4 | 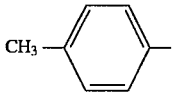 | 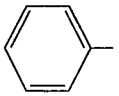 | 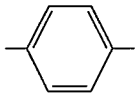 | 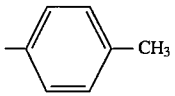 | H | 1 |
| B-5 | 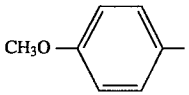 | 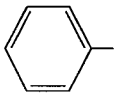 | 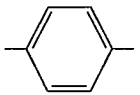 | 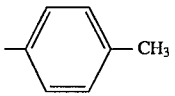 | H | 1 |
| B-6 | 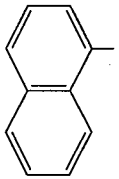 | 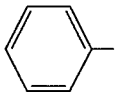 | 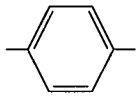 | 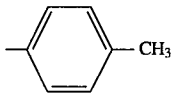 | H | 1 |

-continued
| | | | | | | |
|---|---|---|---|---|---|---|
| B-7 | 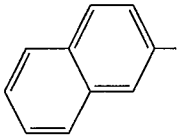 | 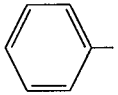 | 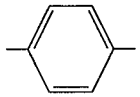 | 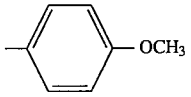 | H | 1 |
| B-8 | 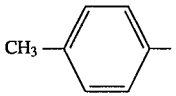 | 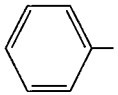 | 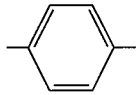 | 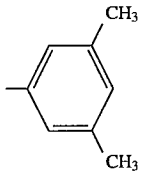 | H | 1 |
| B-9 | 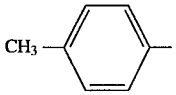 | 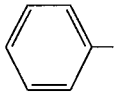 | 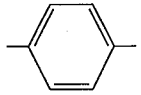 | 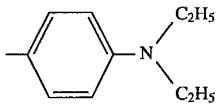 | H | 1 |
| B-10 | 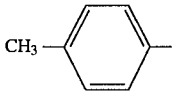 | 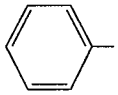 | 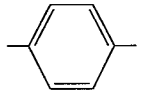 | 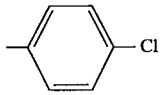 | H | 1 |
| B-11 | 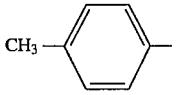 | 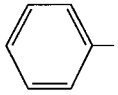 | 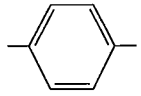 | 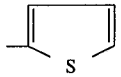 | H | 1 |
| B-12 | 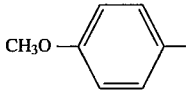 | 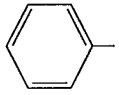 | 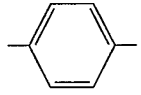 | 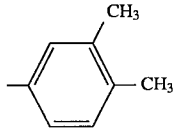 | H | 1 |
| B-13 | 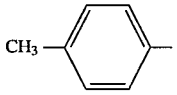 | 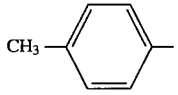 | 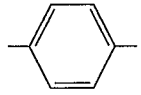 | 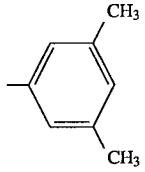 | H | 1 |
| B-14 | 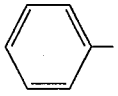 | 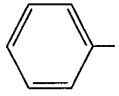 | 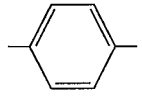 | 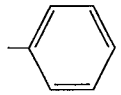 | 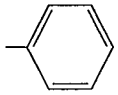 | 1 |

-continued
| | | | | | | |
|---|---|---|---|---|---|---|
| B-15 | 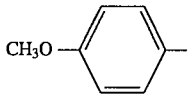 | 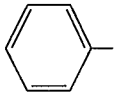 | 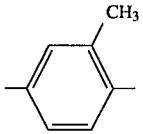 | 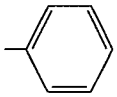 | 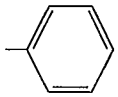 | 1 |
| B-16 | 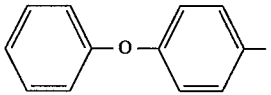 | 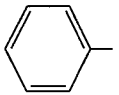 | 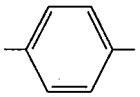 | 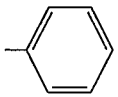 | 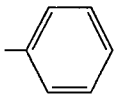 | 1 |
| B-17 | 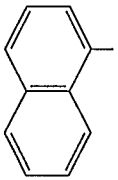 | 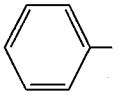 | 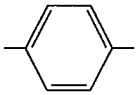 | 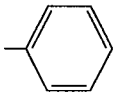 | 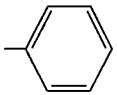 | 1 |
| B-18 | 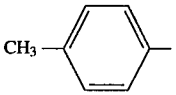 | 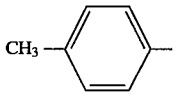 | 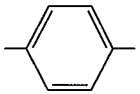 | 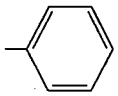 | 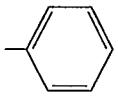 | 1 |
| B-19 | 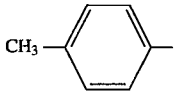 | 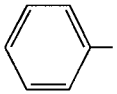 | 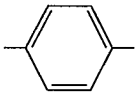 | 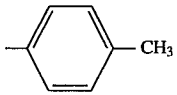 | 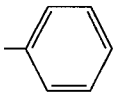 | 1 |
| B-20 | 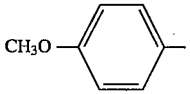 | 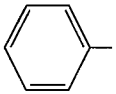 | 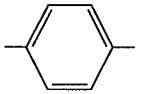 | 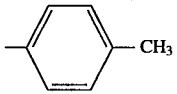 | 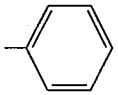 | 1 |
| B-21 | 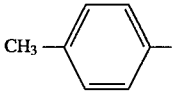 | 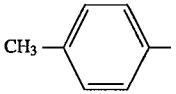 | 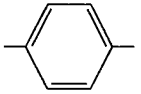 | 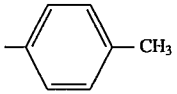 | 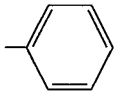 | 1 |
| B-22 | 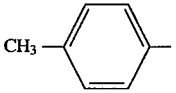 | 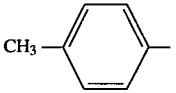 | 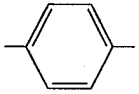 | 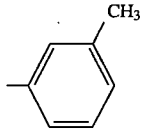 | 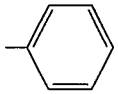 | 1 |

-continued
| | | | | | | |
|---|---|---|---|---|---|---|
| B-23 | 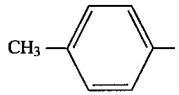 | 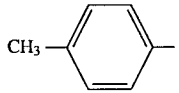 | 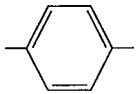 | 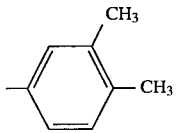 | 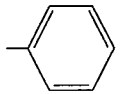 | 1 |
| B-24 | 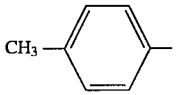 | 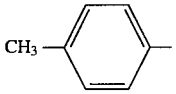 | 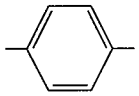 | 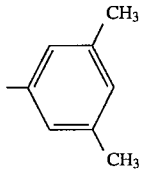 | 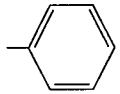 | 1 |
| B-25 | 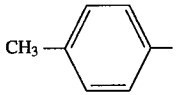 | 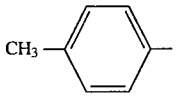 | 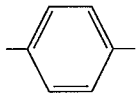 | 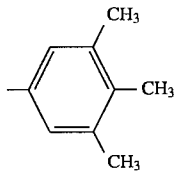 | 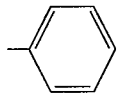 | 1 |
| B-26 | 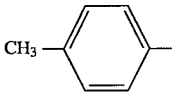 | 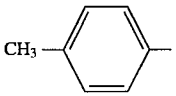 | 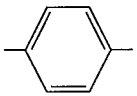 | 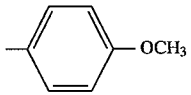 | 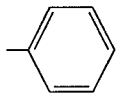 | 1 |
| B-27 | 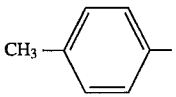 | 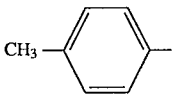 | 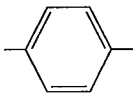 | 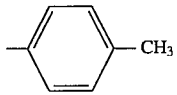 | 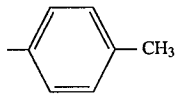 | 1 |
| B-28 | 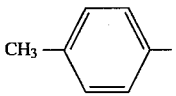 | 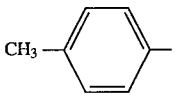 | 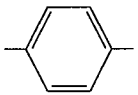 | 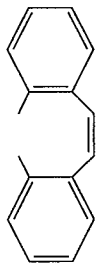 | | 1 |

-continued
| | | | | | | |
|---|---|---|---|---|---|---|
| B-29 | 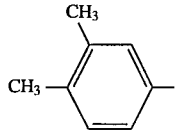 | 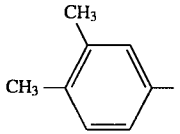 | 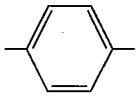 | 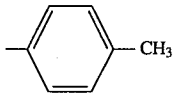 | 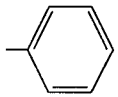 | 1 |
| B-30 | 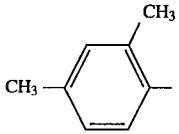 | 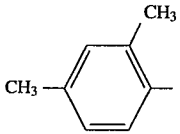 | 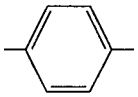 | 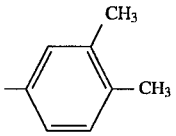 | 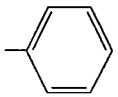 | 1 |
| B-31 | 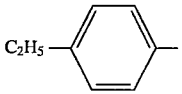 | 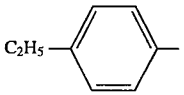 | 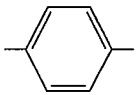 | 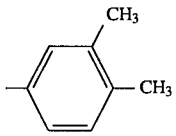 | 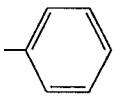 | 1 |
| B-32 | 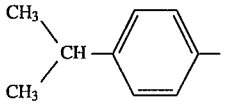 | 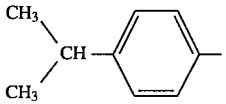 | 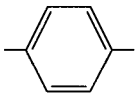 | 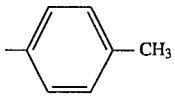 | 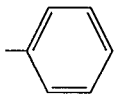 | 1 |
| B-33 | 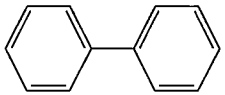 | 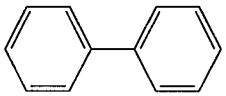 | 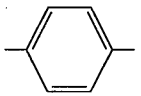 | 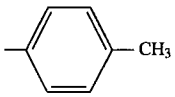 | 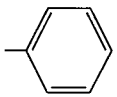 | 1 |
| B-34 | 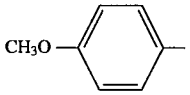 | 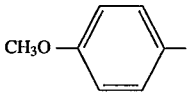 | 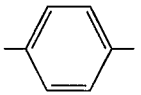 | 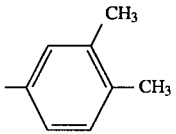 | 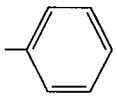 | 1 |
| B-35 | 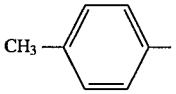 | — | 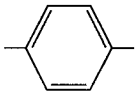 | 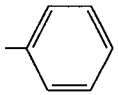 | H | 2 |
| B-36 | 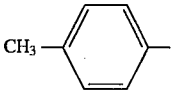 | — | 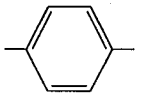 | 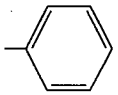 | 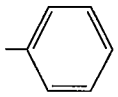 | 2 |

-continued
| | | | | | | |
|---|---|---|---|---|---|---|
| B-37 | 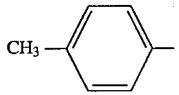 | — | 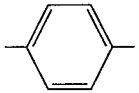 | 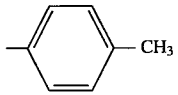 | 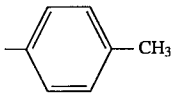 | 2 |
| B-38 | 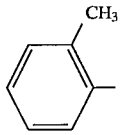 | — | 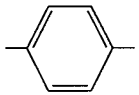 | 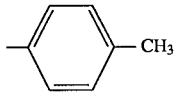 | 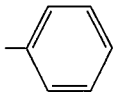 | 2 |
| B-39 | 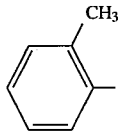 | — | 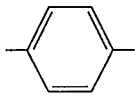 | 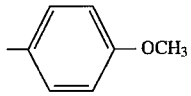 | 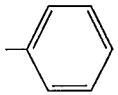 | 2 |
| B-40 | 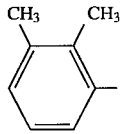 | — | 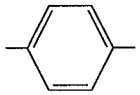 | 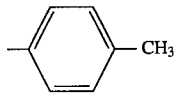 | 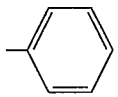 | 2 |
| B-41 | 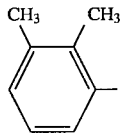 | — | 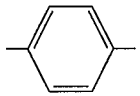 | 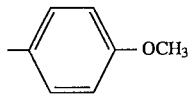 | 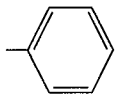 | 2 |
| B-42 | 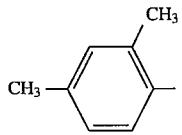 | — | 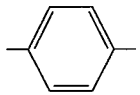 | 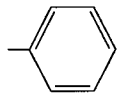 | 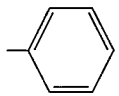 | 2 |
| B-43 | 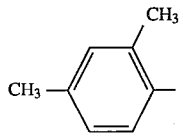 | — | 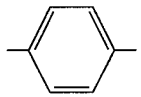 | 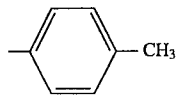 | 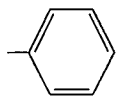 | 2 |

-continued
| | | | | | | |
|---|---|---|---|---|---|---|
| B-44 | 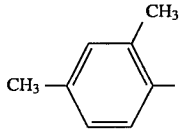 | — | 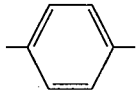 | 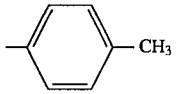 | 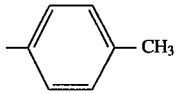 | 2 |
| B-45 | 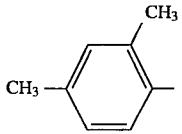 | — | 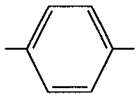 | 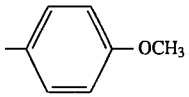 | 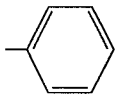 | 2 |
| B-46 | 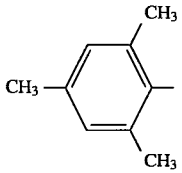 | — | 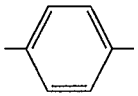 | 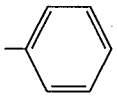 | 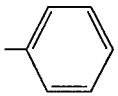 | 2 |
| B-47 | 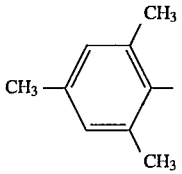 | — | 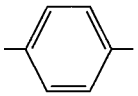 | 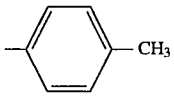 | 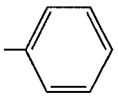 | 2 |
| B-48 | 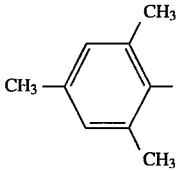 | — | 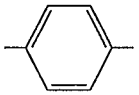 | 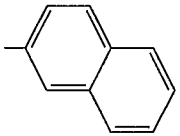 | 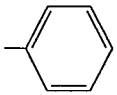 | 2 |
| B-49 | 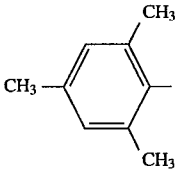 | — | 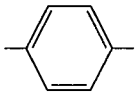 | 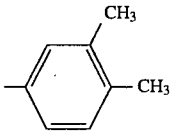 | 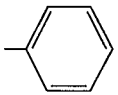 | 2 |

-continued
| | | | | | | |
|---|---|---|---|---|---|---|
| B-50 | 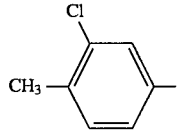 | — | 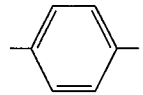 | 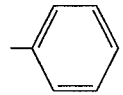 | 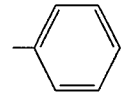 | 2 |
Formula 4:
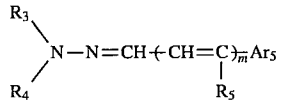
| | $R_3$ | $R_4$ | $R_5$ | $Ar_5$ | m |
|---|---|---|---|---|---|
| C-1 | 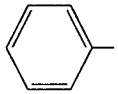 | 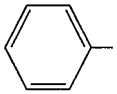 | — | 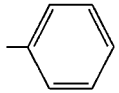 | 0 |
| C-2 | 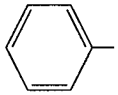 | 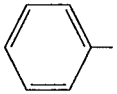 | — | 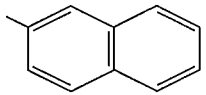 | 0 |
| C-3 | 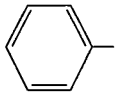 | 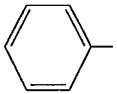 | — | 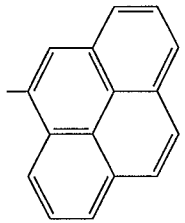 | 0 |
| C-4 | 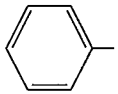 | 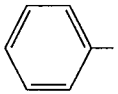 | — | 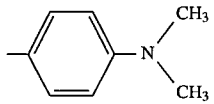 | 0 |
| C-5 | 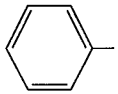 | 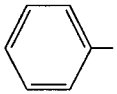 | — | 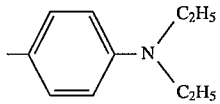 | 0 |

-continued
| | | | | | |
|---|---|---|---|---|---|
| C-6 | 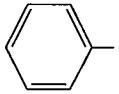 | 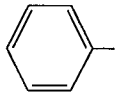 | — | 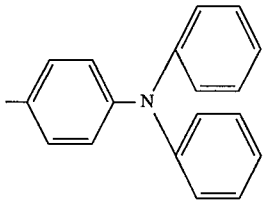 | 0 |
| C-7 | 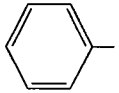 | 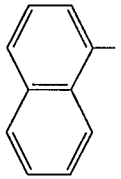 | — | 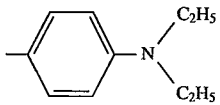 | 0 |
| C-8 | 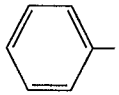 | 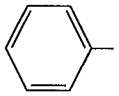 | — | 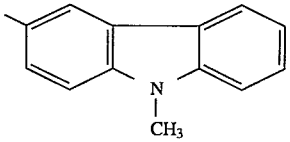 | 0 |
| C-9 | 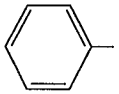 | 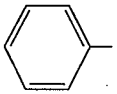 | — | 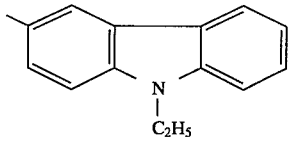 | 0 |
| C-10 | 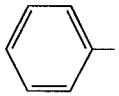 | 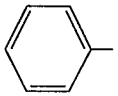 | — | 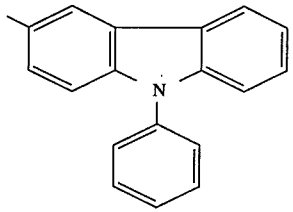 | 0 |

-continued
| | | | | | |
|---|---|---|---|---|---|
| C-11 | 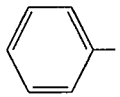 | 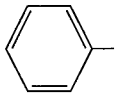 | — | 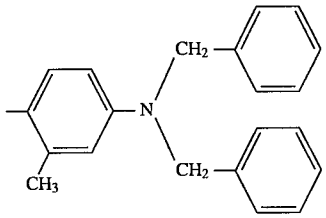 | 0 |
| C-12 | 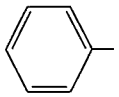 | 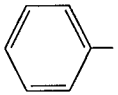 | — | 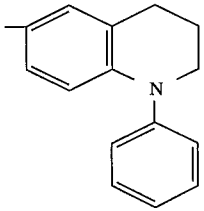 | 0 |
| C-13 | 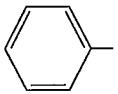 | 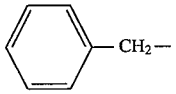 | — | 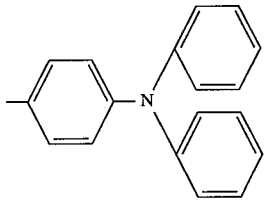 | 0 |
| C-14 | 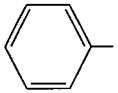 | 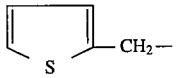 | — | 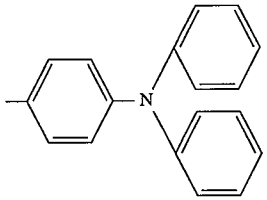 | 0 |
| C-15 | 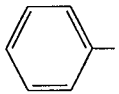 | 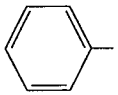 | — | 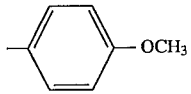 | 0 |

-continued
| | | | | | |
|---|---|---|---|---|---|
| C-16 | | 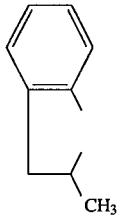 | — | 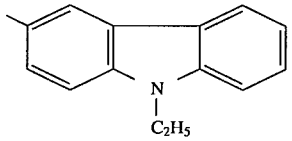 | 0 |
| C-17 | 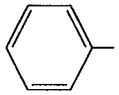 | 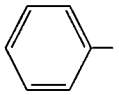 | H | 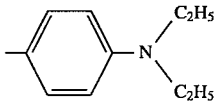 | 1 |
| C-18 | 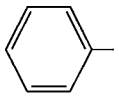 | 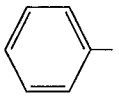 | $CH_3$ | 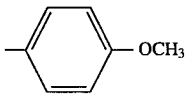 | 1 |
| C-19 | 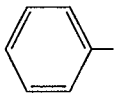 | 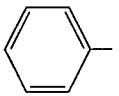 | 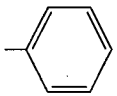 | 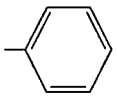 | 1 |
| C-20 | 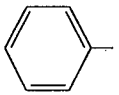 | 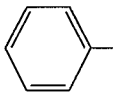 | 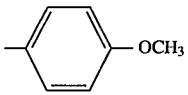 | 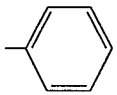 | 1 |
Formula 5:
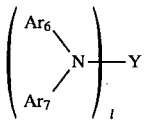
| | $Ar_6$ | $Ar_7$ | Y | l |
|---|---|---|---|---|
| D-1 | 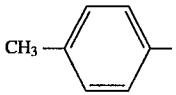 | 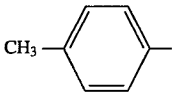 | 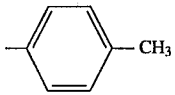 | 1 |
| D-2 | 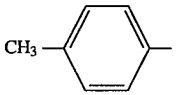 | 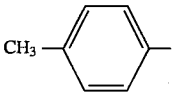 | 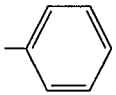 | 1 |

-continued
| | | | | |
|---|---|---|---|---|
| D-3 | 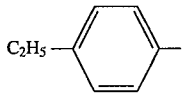 | 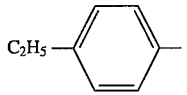 | 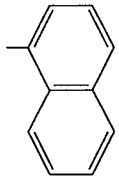 | 1 |
| D-4 | 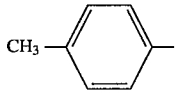 | 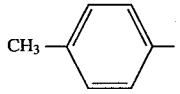 | 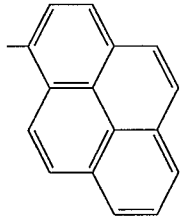 | 1 |
| D-5 | 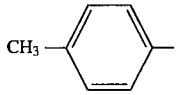 | 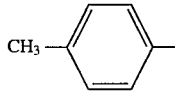 | 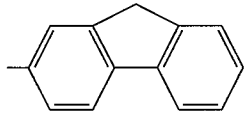 | 1 |
| D-6 | 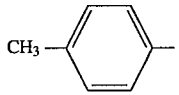 | 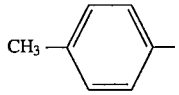 | 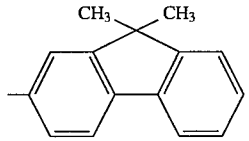 | 1 |
| D-7 | 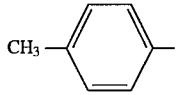 | 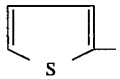 | 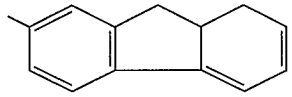 | 1 |
| D-8 | 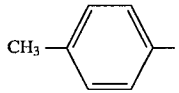 | 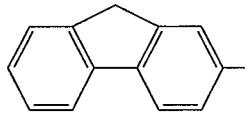 | 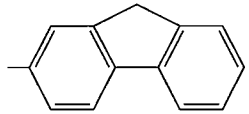 | 1 |
| D-9 | 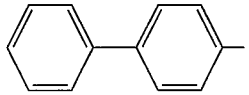 | 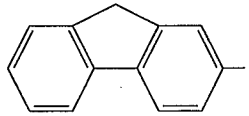 | 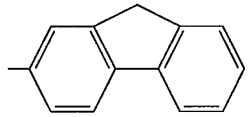 | 1 |

-continued
| | | | | |
|---|---|---|---|---|
| D-10 | 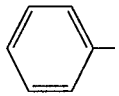 | 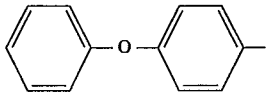 | 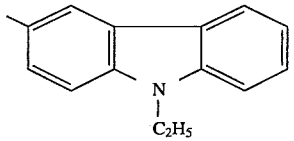 | 1 |
| D-11 | 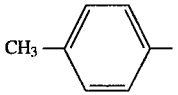 | 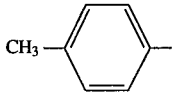 | 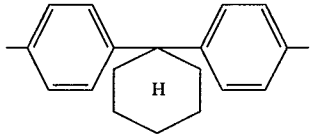 | 2 |
| D-12 | 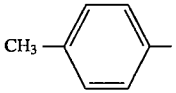 | 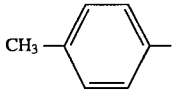 | 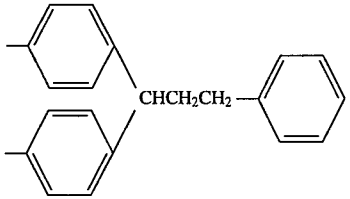 | 2 |
| D-13 | 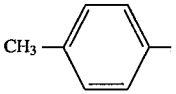 | 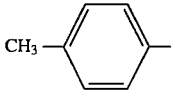 | 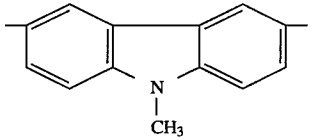 | 2 |
| D-14 | 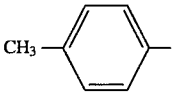 | 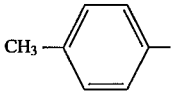 | 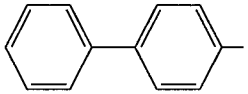 | 2 |
| D-15 | 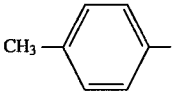 | 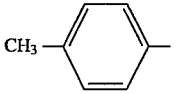 | 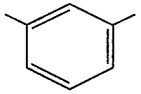 | 2 |
| D-16 | 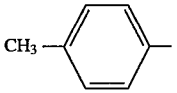 | 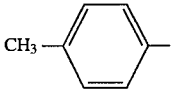 | 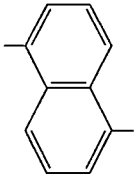 | 2 |

-continued
| | | | | |
|---|---|---|---|---|
| D-17 | 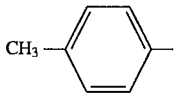 | 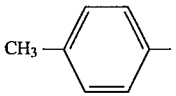 | 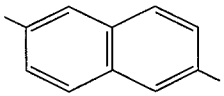 | 2 |
| D-18 | 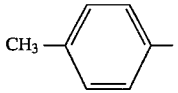 | 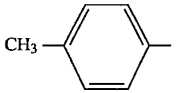 | 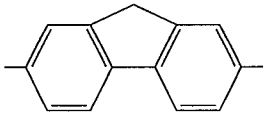 | 2 |
| D-19 | 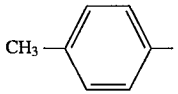 | 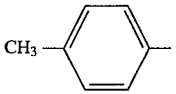 | 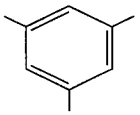 | 3 |
Formula (6)
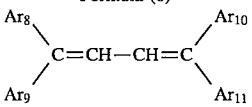
| | $Ar_8$ | $Ar_9$ | $Ar_{10}$ | $Ar_{11}$ |
|---|---|---|---|---|
| E-1 | 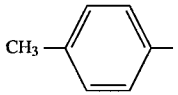 | 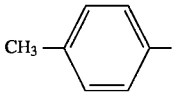 | 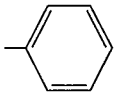 | 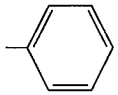 |
| E-2 | 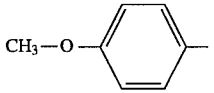 | 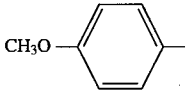 | 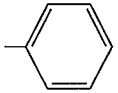 | 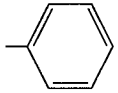 |
| E-3 | 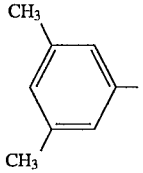 | 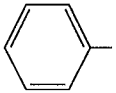 | 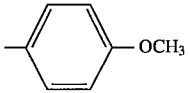 | 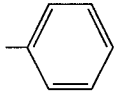 |
| E-4 | 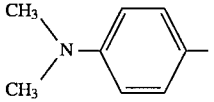 | 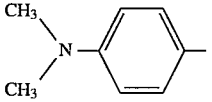 | 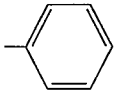 | 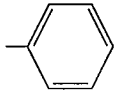 |

-continued
| | | | | |
|---|---|---|---|---|
| E-5 | 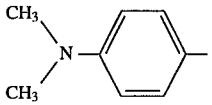 | 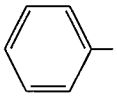 | 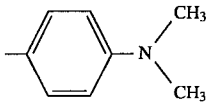 | 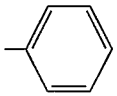 |
| E-6 | 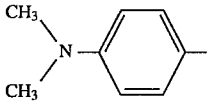 | 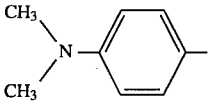 | 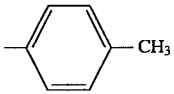 | 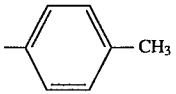 |
| E-7 | 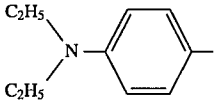 | 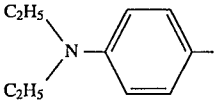 | 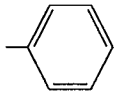 | 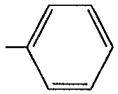 |
| E-8 | 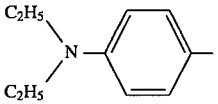 | 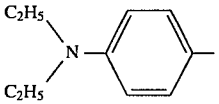 | 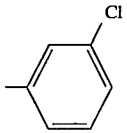 | 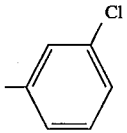 |
| E-9 | 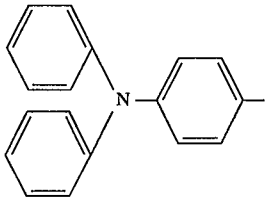 | 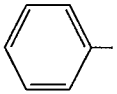 | 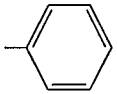 | 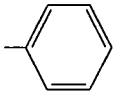 |
| E-10 | 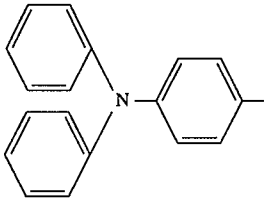 | 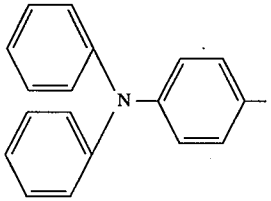 | 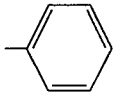 | 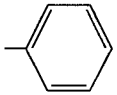 |

In general, as previously stated, in order to obtain high-sensitivity photoreceptor characteristics, it is firstly necessary to obtain a uniform coating film in which a carrier generation material has been made into fine particles. However, as a result of the studies made by the present inventors, in addition to the sensitization effect obtained when the compound is made into fine particles, the perylene compound of the present invention may undergo a physical damage in the insides or on the surfaces of crystals because of a strong shear force applied to pulverize particles, depending on the manner of making it into fine particles, and may cause a desensitization effect, so that its sensitivity characteristics tend to greatly lower on the contrary. Now, it is preferable in the course of pulverization to make the pigment into fine particles under a shear force as small as possible. In the present invention, it is preferable to carry out acid paste treatment and to use a pigment having small particle diameters and also having a uniform particle size.

The solvent or dispersion medium used in the coating solution to form the carrier generation layer of the present invention may include n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2 -dichloroethane, 1,2-dichloropropane, 1,1,2-trichloroethane, 1,1,1-trichloroethane, trichloroethylene, tetrachloroethane, tetrahydrofuran, dioxane, methanol, ethanol, isopropanol, ethyl acetate, butyl acetate, dimethylsulfoxide and methyl cellosolve. The solvent used in the present invention is by no means limited to these. Use of ketone type solvents brings about more improvements in sensitivity and in potential change when the photoreceptor is repeatedly used. Any of these solvents may be used alone or as a mixed solvent of two or more kinds.

As a binder resin used in the carrier generation layer, polyamide, polyurethane, polyester, epoxy resin, polyketone, polycarbonate, silicone resin, acrylic resin, polyvinyl butyral, polyvinyl formal, polystyrene, etc. may be used. The binder resin used in the present invention is by no means limited to these. Use of polyvinyl butyral resin brings about more improvement in sensitivity and in potential change when the photoreceptor is repeatedly used. Any of these binder resins may be used alone or as a mixture of two or more kinds.

In the carrier generation layer thus formed, the carrier generation material and the binder may preferably be in a weight ratio of from 100:1 to 1:100.

If the carrier generation material is contained in a proportion smaller than the above, it may cause a lowering of photosensitivity and an increase in residual potential. If in a proportion larger than the above, it may result in an increase in dark decay and a lowering of received potential.

In an instance where the carrier transportation material is contained in the carrier generation layer, the carrier generation material and the carrier transportation material may preferably be in a proportion of from 10:0 to 10:1,000, and particularly preferably from 10:0 to 10:100, in weight ratio.

The carrier generation layer may preferably have a layer thickness of from 0.01 to 10 μm.

The carrier generation layer may be formed by using a usual coating process such as blade coating, wire bar coating, spray coating, dip coating or bead coating.

The carrier transportation layer of the present invention will be described below.

The carrier transportation layer is formed of the carrier transportation material represented by Formulas 3, 4, 5 or 6 and a binder resin.

As the binder resin used in the carrier transportation layer, a vast range of insulating resins may be used under appropriate selection therefrom. As preferred resins, the binder resin may include insulating resins such as polyester resins, methacrylic resins, acrylic resin, polyvinyl chloride resins, polyvinylidene chloride resins, polystyrene resins, polycarbonate resins, polyvinyl acetate resins, styrene/butadiene copolymer resins, vinylidene chloride/acrylonitrile copolymer resins, vinyl chloride/vinyl acetate/maleic anhydride copolymer resins, silicone resins, silicone/alkyd resins, phenol/formaldehyde resins, polyvinyl carbazole, and polysilane. Examples are by no means limited to these. Any of these binder resins may be used alone or in the form of a mixture of two or more kinds.

As the solvent used in the coating solution to form the carrier generation layer, it may include aromatic hydrocarbons such as benzene, xylene and chlorobenzene, ketones such as acetone and 2-butanone, halogenated aliphatic hydrocarbons such as methylene chloride, chloroform and ethylene chloride, cyclic or linear ethers such as tetrahydrofuran and ethyl ether, which are organic solvents usually used and may be used alone or in the form of a mixture of two or more kinds.

The binder resin and the carrier transportation material may be mixed in a proportion of from 1:10 to 1:500, and may preferably from 1:20 to 1:150. The carrier transportation layer may have a thickness of from 1 to 100 μm, and preferably from 5 to 50 μm.

The support of the electrophotographic photoreceptor of the present invention may have a surface roughness. The support surface roughness employed in the present invention is defined in accordance with what is prescribed in JIS surface roughness (B0601-1982).

Figure 14:
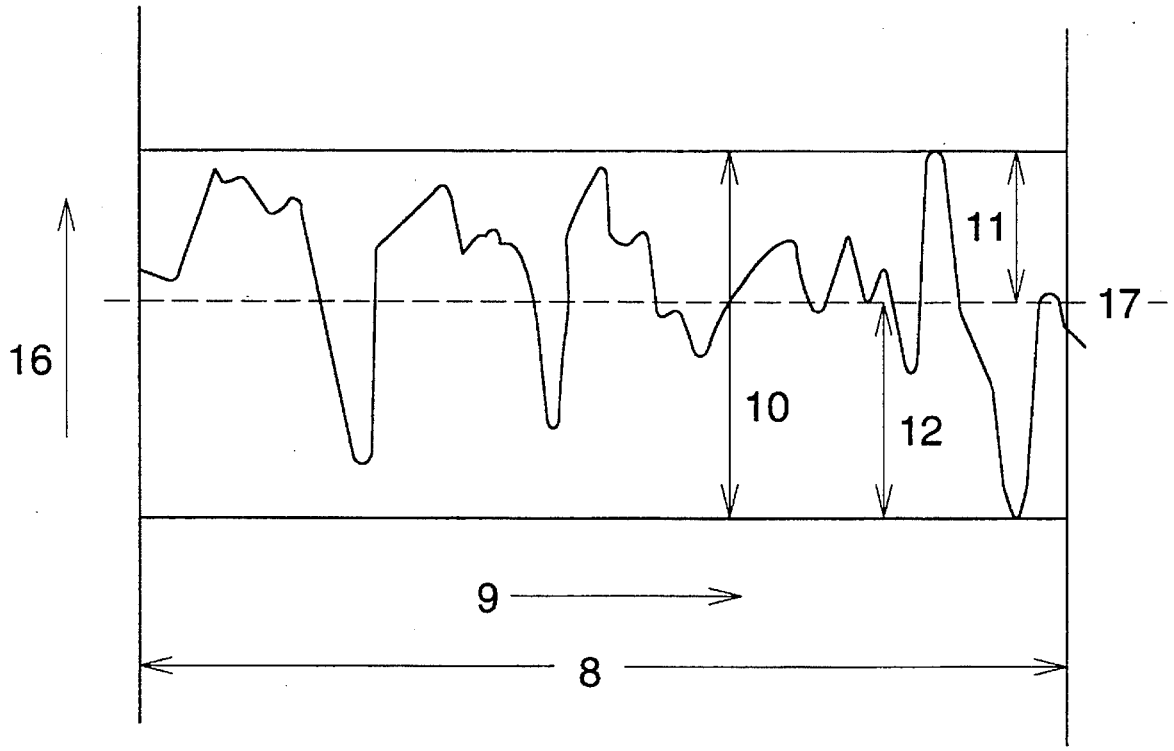
FIG. 14 is a view for explaining how to measure the surface roughness of the support used in the present invention.

FIG. 14 is a roughness cross section (i.e., roughness curve) of the support. In the drawing, reference numeral 8 denotes a standard length L; 17, an average line X; and 11, a height Rp from the average line X to the top of the highest hill within the standard length L, that is to say, a depth for the top of the highest hill to the average line. Reference numeral 12 denotes a depth Rv from the average line X to the bottom of the deepest valley; and 10, a peak-to-valley width Rmax between the highest hill and the deepest valley, which corresponds to a maximum height of the roughness curve. In the present invention, the support may have a surface roughness such that Rp is 0.11 μm≦Rp≦0.8 μm and Rmax is 0.2 μm≦Rmax≦1.6 μm.

The above average line X is a line at which the total sum of the square of distance between every point on the roughness curve and the average line X becomes minimum. The average line depth Rp and the maximum peak-to-valley width Rmax of the roughness curve can be measured and recorded using an optical surface profile analyzer SURCOM 470A (trade name, manufactured by Tokyo Seimitsu Co.), equipped with an optical feeler type pick-up E-DT-SL024.

Here, if in the support of the present invention the Rp is greater than 0.8 μm, parts of, for example, a support forming machine, in particular, a die may abrade on its working surface to a level no longer applicable to practical use, and may have to be changed for new one. If the Rmax is greater than 1.6 μm, metal powder or dust may stiff adhere to the surface of a conductive support and may have to be cleaned and removed.

In order to make the Rmax smaller than 0.2 μm, it is difficult to do so by forming methods and forming means currently used. Although the surface need not be made comparable to that of mirror finishing, it becomes necessary to carry out finishing.

Figure 15:
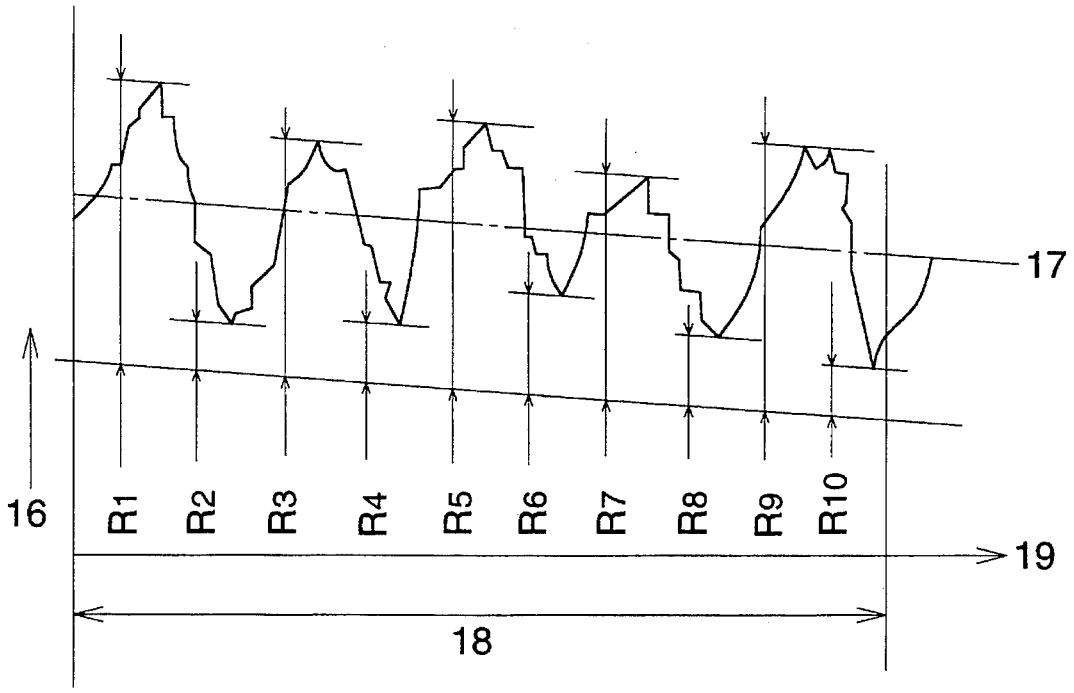
FIG. 15 is a schematic view for explaining how to calculate ten-point average surface roughness (Rz).

Meanwhile, with regard to a ten-point average surface roughness Rz, FIG. 15 shows a method for its calculation.

The above average line X 17 is a line at which the total sum of the square of distance between every point on the roughness curve and the average line X becomes minimum. The ten-point average surface roughness Rz can be measured and recorded using an optical surface profile analyzer SURCOM 470A (trade name, manufactured by Tokyo Seimitsu Co.) equipped with an optical feeler type pick-up E-DT-SL024.

Here, if the Rz is greater than 1.50 μm, problems of black dots and fog may occur. If the Rz is less than 0.20 μm, interference fringes can not be prevented from being caused by laser exposure or the like.

In the present invention, an intermediate layer may be provided between the carrier generation layer and the carrier transportation layer. In such as case, the intermediate layer may have a layer thickness ranging from 0.01 to 15 μm, and preferably from 0.05 to 3 μm. If the thickness is smaller than 0.01 μm, the injection of charges from the support into the photosensitive layer can not be blocked. Also, pin-holes tend to occur in the photoreceptor because of irregularities of the support. If it is larger than 15 μm, the residual potential of the photosensitive layer can not be effectively removed.

The intermediate layer of the present invention will be described below in detail.

In the present invention, the electrophotographic photoreceptor can have superior charge potential, dark decay characteristics, residual potential and image characteristics when a polyamide resin is contained in the intermediate layer, and can have superior sensitivity and exhibit stable characteristics without causing so much changes in potential during repeated use when the perylene pigment having the specific crystal form is contained in the carrier generation layer. More specifically, it has been found that the combination of the intermediate layer mainly composed of a polyamide resin and the carrier generation layer containing as the carrier transportation material the perylene pigment having the specific crystal form provides an electrophotographic photoreceptor having a very good performance. It has been also discovered that the stated effects become more remarkable when the perylene pigment is purified by sublimation and treated to the acid paste treatment and the carrier generation layer is formed using the dispersion prepared by dispersing the pigment in a ketone type solvent together with a polyvinyl butyral resin.

The intermediate layer can be made to have the function as an adherent layer between the conductive support and the photoconductive layer and also to play a role as a barrier layer that prevents charges from being injected from the support. Hence, the intermediate layer must be hardly attacked by the solvent used when the upper layer photosensitive layer is formed by coating.

In this intermediate layer, an alcohol-soluble polyamide resin of a copolymerization type or modification type is used. Such a copolymerization type polyamide is exemplified by copolymers such as nylon 6, nylon 8, nylon 11, nylon 12, nylon 66, nylon 610 and nylon 612. Stated specifically, the following are preferably used.

(1) DAIAMIDO T-170 (trade name; available from Daicel-Hules, Ltd.), a copolymer mainly composed of nylon 12.
(2) ALAMIN CM800 (trade name; available from Toray Industries, Inc.), a 6/66/610/12 copolymer nylon.
(3) ULTRAMID 1c (trade name; available from BASF Japan Ltd.), a 6/66/610 copolymer nylon.
(4) ELBAMIDE 8061 (trade name; available from Du Pont Japan Ltd.), a 6/66/610 copolymer nylon.

As a polyamide resin dissolved in methyl alcohol in an amount of not less than 0.1% by weight, it includes alkyl-modified polyamide resins such as N-methyl-modified nylon 6, methoxymethyl-modified nylon 6, N-ethyl-modified nylon 6 and ethoxymethyl-modified nylon 8, and particularly preferably methoxymethyl-modified nylon 6 polyamide resin. Stated specifically, the following may be used.

(1) LUCKAMIDE 5003 (trade name; available from Dainippon Kagaku Kogyo K.K.).
(2) LUCKAMIDE 5216 (trade name; available from Dainippon Kagaku Kogyo K.K.).
(3) TORESIN F30 (trade name; available from Teikoku Chemical Industry Co., Ltd.).
(4) TORESIN EF-20T (trade name; available from Teikoku Chemical Industry Co., Ltd.).

A polyamide resin dissolved in methyl alcohol in an amount of not less than 0.5% by weight may also preferably be used.

The solvent used may include, for example, methyl alcohol, ethyl alcohol, propyl alcohol, isopropyl alcohol, butyl alcohol and isobutyl alcohol.

The intermediate layer may have any desired layer thickness, preferably a thickness of 10 μm or less, and particularly 1 μm or less.

The intermediate layer can be formed by any suitable methods such as spray coating, dip coating, knife coating and roll coating.

The formation of this intermediate layer is effective on charge performance, which can be remarkable especially when the conductive support is comprised of a metal such as Al or Ni.

The photoreceptor can be constituted in various embodiments. It may typically have the constitution as shown in FIGS. 1(*a*) to 1(*f*). In the embodiment of FIG. 1(*a*), a carrier generation layer 2 is formed on a conductive support, and a carrier transportation layer 3 is superposingly formed thereon to provide a photosensitive layer. In the embodiment of FIG. 1(*b*), the carrier generation layer and the carrier transportation layer are formed in reverse order to provide a photosensitive layer 4'. In the embodiment of FIG. 1C, an intermediate layer 5 is provided between the photosensitive layer 4 and the conductive support 1 in the layer configuration of FIG. 1A. In the embodiment of FIG. 1D, the intermediate layer 5 is provided between the photosensitive layer 4' and the conductive support 1 in the layer configuration of FIG. 1B. In the embodiment of FIG. 1E, a photosensitive layer 4" containing a carrier generation material and a carrier transportation material in the same layer is formed, and in the embodiment of FIG. 1F the intermediate layer 5 is provided between such a photosensitive layer 4" and the conductive support 1. In the embodiments shown in FIGS. 1A to 1F, the outermost layer may be further provided thereon with a protective layer.

The carrier generation layer can be formed by bar coating, spin coating, applicator coating, spray coating, dip coating or the like, using the dispersed coating solution in which the crystalline state of the carrier generation material has been adjusted in the manner described above. As a device useful for dispersing the carrier generation material, an ultrasonic dispersion machine, a ball mill, a sand mill, a homomixer, a paint shaker or the like may be used. In the formation of the carrier generation layer, it is advantageous to use a binder.

The carrier transportation layer can be formed by the same coating process as described for the formation of the carrier generation layer, using a solution in which the carrier transportation material has been dissolved. In order to improve mechanical properties of the photosensitive layer, it is preferable to use a polymer binder, which is dissolved in the solvent together with the carrier transportation material when used.

The carrier transportation material may be in a proportion of from 10 to 500% by weight, and more preferably from 20 to 150% by weight, based on the weight of the binder. The carrier generation layer may be in a thickness of from 0.01 to 20 μm, and more preferably from 0.05 to 5 μm. The carrier transportation layer may be in a thickness of from 1 to 100 μm, and more preferably from 5 to 50 μm.

The polymer useful as the binder used in the carrier transportation layer and intermediate layer may include, for example, polycarbonate, acrylic resins, methacrylic resins, polyvinyl chloride, vinyl chloride copolymer resins, polyvinylidene chloride, polystyrene, styrene copolymers, polyvinyl acetate, polyvinyl formal, polyvinyl butyral, polyvinyl acetal, polyvinyl carbazole, silicone resins, silicone copolymer resins, polyesters, phenoxy resins, phenol resins, polyurethanes and epoxy resins.

As the conductive support, a metal sheet or plate or a metal drum may be used. It is also possible to use a base material such as paper or plastic film provided thereon with a thin film of a conductive polymer or a conductive compound such as indium oxide or a metal such as aluminum or palladium by a means such as coating, deposition or lamination.

An electron acceptable material may be contained in the photosensitive layer for the purposes of improving sensitivity, decreasing residual potential and decreasing fatigue at the time of repeated use. Such an electron acceptable material may include, for example, succinic anhydride, maleic anhydride, dibromosuccinic anhydride, phthalic anhydride, tetrachlorophthalic anhydride, tetrabromophthalic anhydride, 2-nitrophthalic anhydride, 4-nitrophthalic anhydride, pyromellitic anhydride, mellitic anhydride, tetracyanoethylene, tetracyanoquinodimethane, o-dinitrobenzene, m-dinitrobenzene, 1,3,5-trinitrobenzene, p-nitrobenzonitrile, picryl chloride, quinonechloroimide, chloranil, bromanil, dichlorodicyano-p-benzoquinone, anthraquinone, dinitroanthraquinone, 9-flurenylidene malonodinitrile, polynitro-9-fluorenylidene malonodinitrile, picric acid, o-nitrilobenzoic acid, p-nitrobenzoic acid, 3,5-dinitrobenzoic acid, pentafluorobenzoic acid, 5-nitrosalicylic acid, 3,5-dinitrosalicylic acid, phthalic acid, mellitic acid, and other compounds having an electron affinity. The electron acceptable material may preferably be added in a proportion of from 0.01 to 200, and more preferably from 0.1 to 100, based on the weight 100 of the carrier generation material.

EXAMPLES

The present invention will be specifically described below by giving Examples.

In the present Examples, "part(s)" refers to "part(s) by weight" unless particularly noted.

Figure 3:
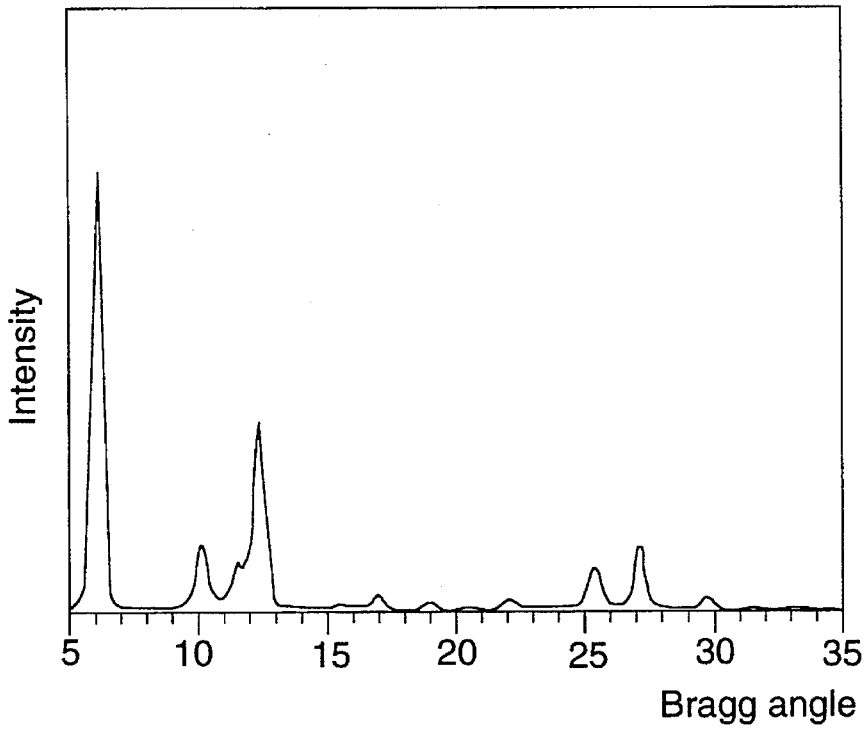
FIG. 3 is an X-ray diffraction spectrum of an imidazole perylene compound (a synthesized product).

Synthesis Example 39.2 g of perylene-3,4,9,10-tetracarboxylic acid dianhydride, 32.4 g of o-phenylenediamine and 800 ml of α-chloronaphthalene were mixed, and the mixture was reacted at 260° C. for 6 hours. After the reaction product was left to cool, deposited crystals were collected by filtration, and were then repeatedly washed with methanol, followed by heating and drying to obtain 51.1 g of an imidazole perylene compound as a mixture of the compounds of Structural formulas 1 and 2. The product thus obtained was called a synthesized product, whose X-ray diffraction spectrum was as shown in FIG. 3.

Sublimation Example

Figure 4:
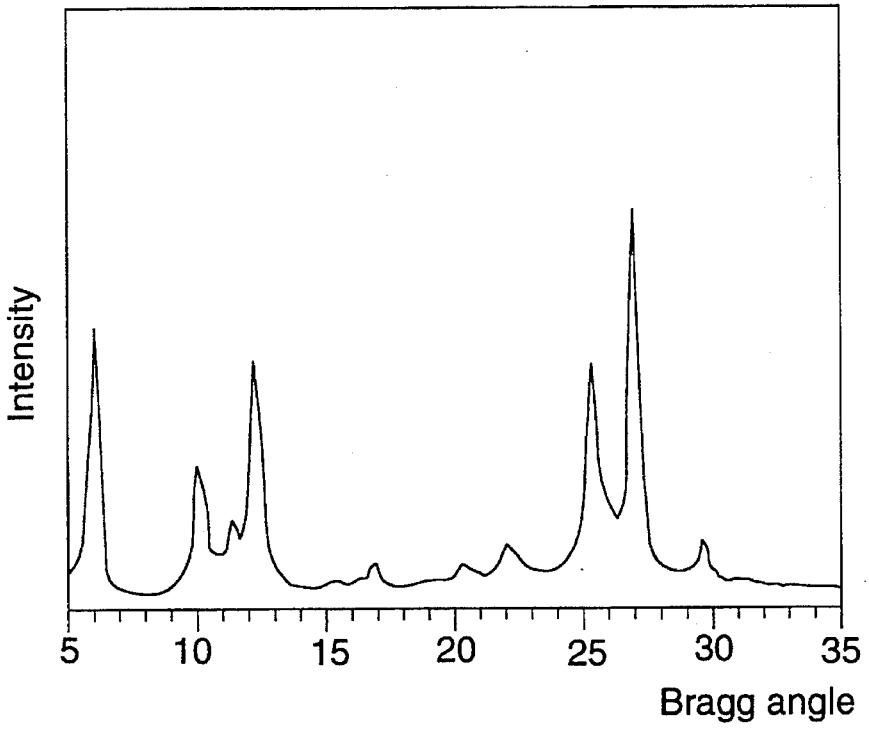
FIG. 4 is an X-ray diffraction spectrum of an imidazole perylene compound (a sublimated product).

The imidazole perylene compound obtained in Synthesis Example was purified by sublimation under heating conditions of 500° C. under application of a pressure of $5\times10^{-4}$ to $5\times10^{-3}$ torr. Volatile impurities were removed by using a shutter. The purified crystals obtained were once again subjected to a like sublimation treatment to further make their purity higher. The product obtained after the sublimation operated twice was called a sublimated product, whose X-ray diffraction spectrum was as shown in FIG. 4.

Acid Paste Treatment Example

Figure 5:
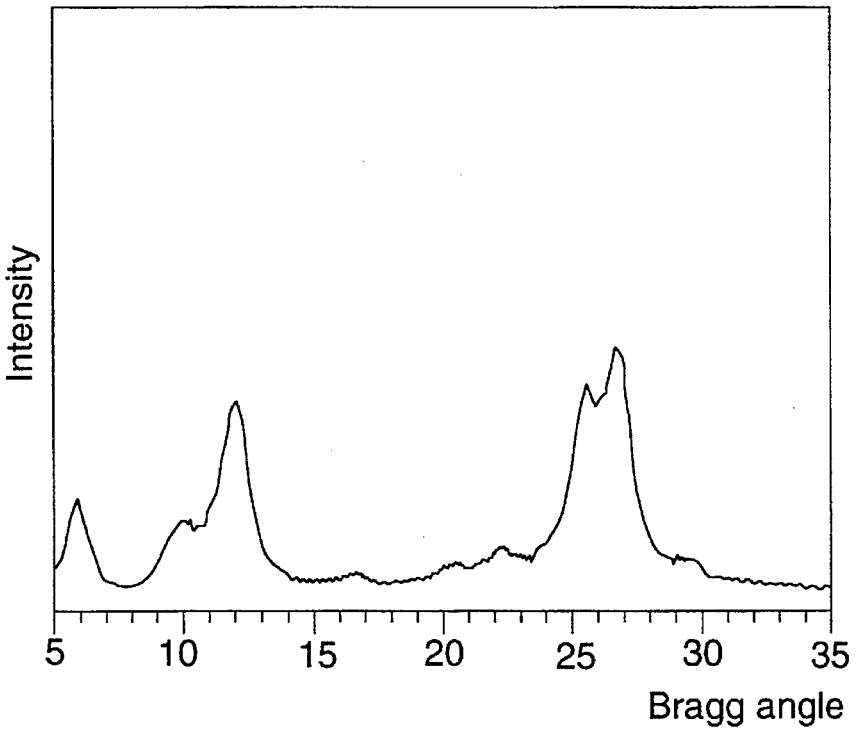
FIG. 5 is an X-ray diffraction spectrum of an imidazole perylene compound (an acid paste treated product).

A solution prepared by dissolving 20 g of the sublimated product of imidazole perylene compound in 600 ml of concentrated sulfuric acid was filtered with a glass filter, and thereafter dropwise added in 1,200 ml of pure water to carry out precipitation. The precipitates formed were called an AP product (acid paste treated product), whose X-ray diffraction spectrum was as shown in FIG. 5.

Example 1

Figure 6:
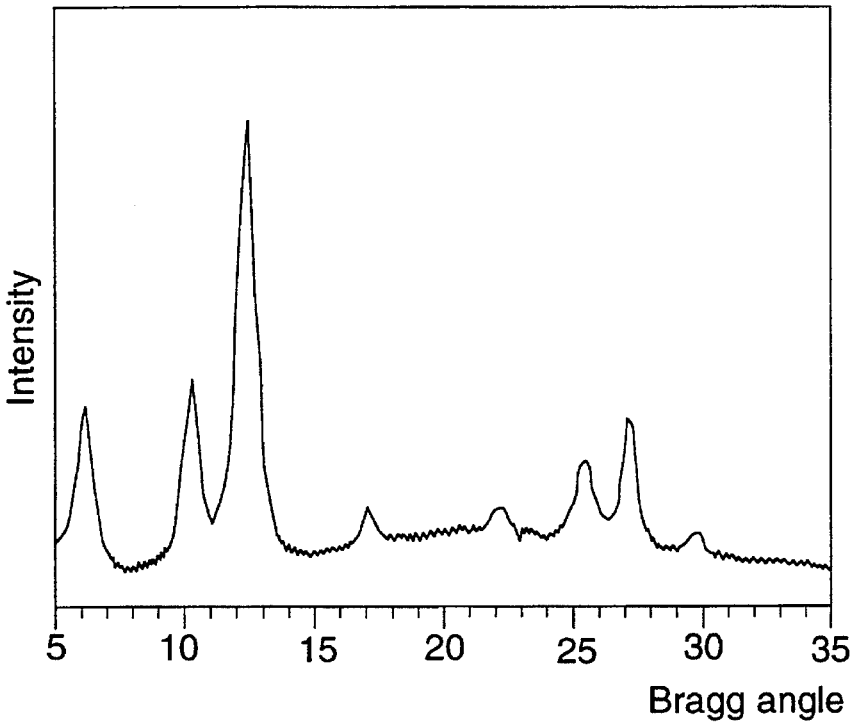
FIG. 6 is an X-ray diffraction spectrum of the imidazole perylene compound in Example 1.

In a sand mill filled with glass beads, 7 g of the AP product of the imidazole perylene compound, 1.5 g of polyvinyl butyral resin S-LEC BLS (trade name; available from Sekisui Chemical Co., Ltd.) and 250 ml of methyl ethyl ketone were charged to carry out dispersion for 15 hours. A portion of the dispersion thus obtained was concentrated to dryness to measure its X-ray diffraction spectrum. The results obtained were as shown in FIG. 6. The intensity of the peak at 12.4°±0.2° was maximum, and the half width was 0.86°. No clear peak was also seen at 11.5°±0.2°.

The dispersion thus obtained was coated on an aluminum vacuum deposited polyester base by means of a wire bar to form a carrier generation layer with a layer thickness of 0.3 μm. Subsequently, on this layer, a solution prepared by dissolving 1 part of carrier transportation material B-23 and 14 parts of polycarbonate resin Z-200 (trade name; available from Mitsubishi Gas Chemical Company, Inc.) in 10 parts of 1,2 -dichloroethane was coated with a blade coater, and followed by drying to obtain a carrier transportation layer with a layer thickness of 25 μm.

The photoreceptor thus obtained is designated as Sample 1.

Example 2

Figure 7:
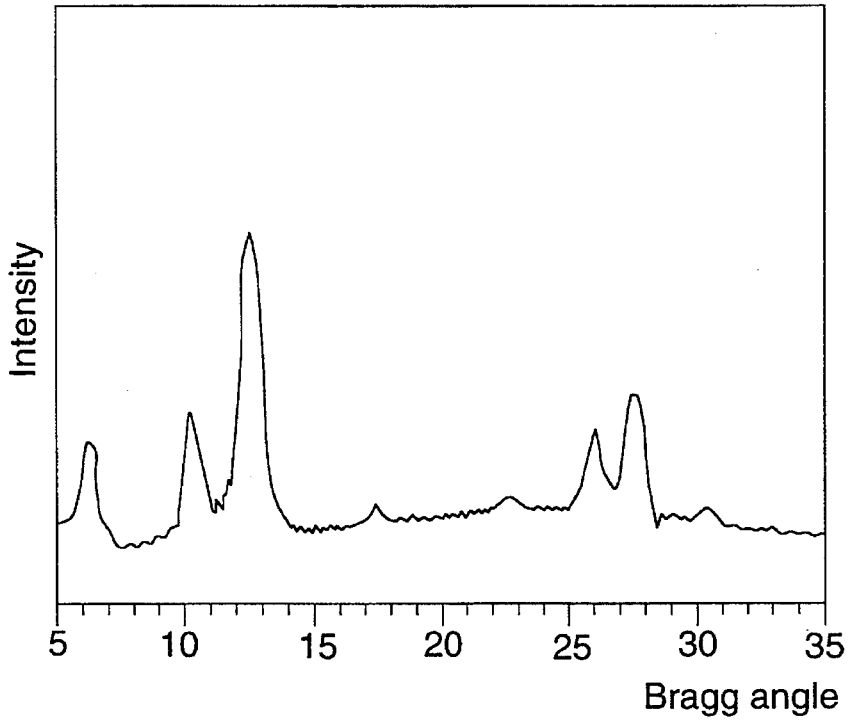
FIG. 7 is an X-ray diffraction spectrum of the imidazole perylene compound in Example 2.

Dispersion was carried out in the same manner as in Example 1 except that the methyl ethyl ketone was replaced with 250 ml of 1,2-dichloroethane, to obtain a dispersion. The X-ray diffraction spectrum of the dispersion obtained was measured, which was as shown in FIG. 7. The intensity of the peak at 12.4°±0.2° was maximum, and the half width was 0.94°. No clear peak was also seen at 11.5°±0.2°. Using this dispersion, a photoreceptor was produced in the same manner as in Example 1.

This photoreceptor is designated as Sample 2.

Example 3

Figure 8:
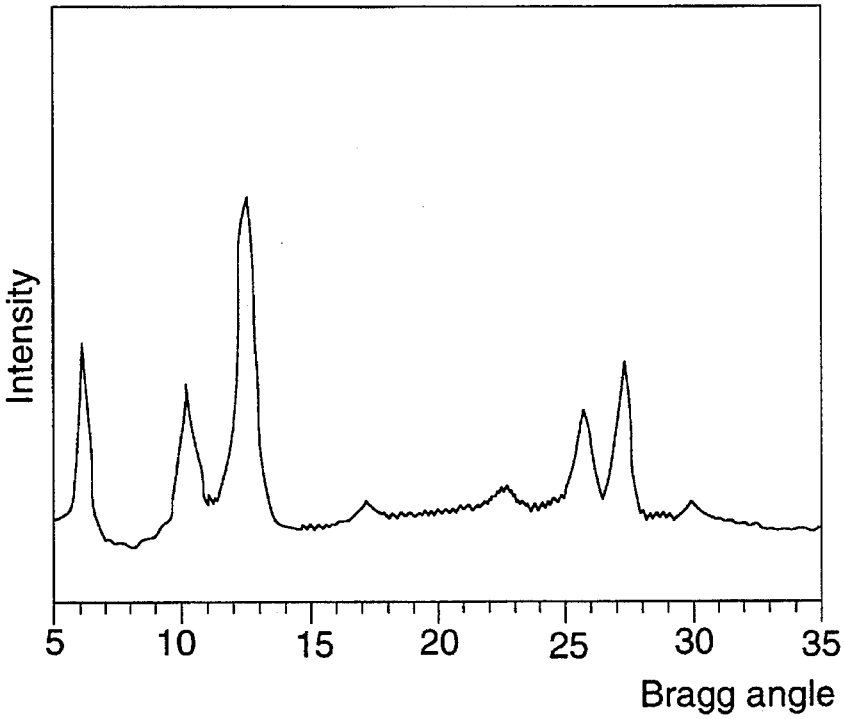
FIG. 8 is an X-ray diffraction spectrum of the imidazole perylene compound in Example 3.

Dispersion was carried out in the same manner as in Example 1 except that the methyl ethyl ketone was replaced with 250 ml of tetrahydrofuran, to obtain a dispersion. The X-ray diffraction spectrum of the dispersion obtained was measured, which was as shown in FIG. 8. The intensity of the peak at 12.4°±0.2° was maximum, and the half width was 0.68°. No clear peak was also seen at 11.5°±0.2°. Using this dispersion, a photoreceptor was produced in the same manner as in Example 1.

This photoreceptor is designated as Sample 3.

Comparative Example 1

Figure 9:
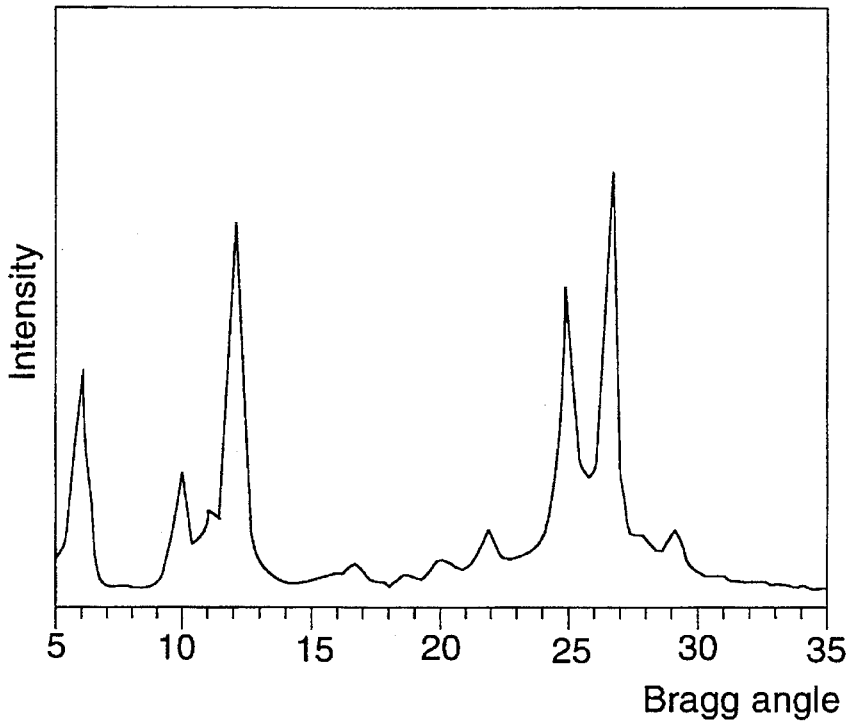
FIG. 9 is an X-ray diffraction spectrum of the imidazole perylene compound in Comparative Example 1.

Dispersion was carried out in the same manner as in Example 1 except that the sand mill dispersion machine was replaced with an ultrasonic dispersion machine, to obtain a dispersion. The X-ray diffraction spectrum of the dispersion obtained was measured, the results of which were as shown in FIG. 9. Crystal growth occurred in excess and the half width of the peak at 12.4°±0.2° was 0.60°. A peak was also seen at 11.5°±0.2°. Using this dispersion, a photoreceptor was produced in the same manner as in Example 1.

This photoreceptor is designated as Comparative Sample (1).

Comparative Example 2

Figure 10:
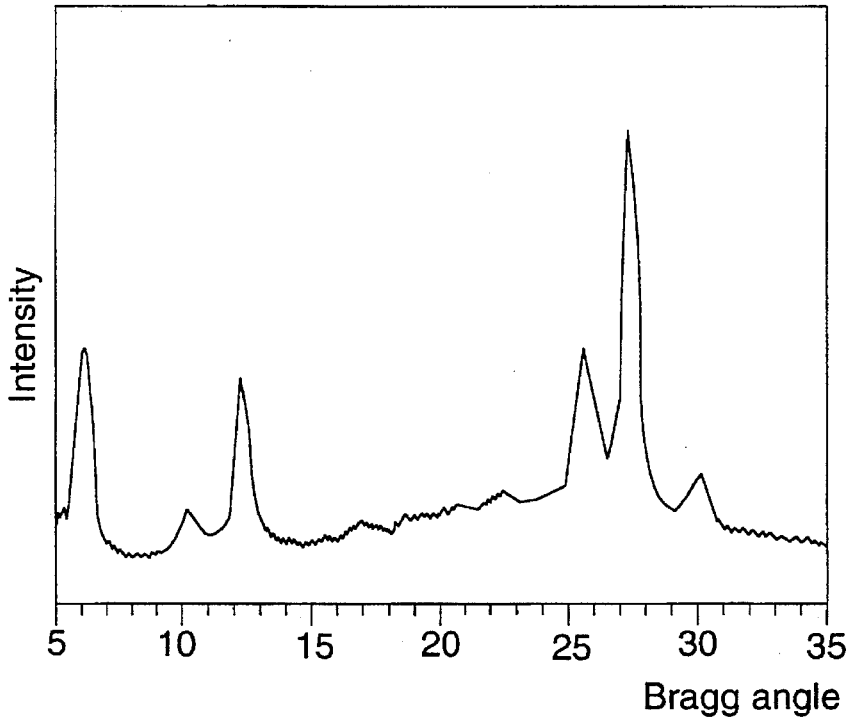
FIG. 10 is an X-ray diffraction spectrum of the imidazole perylene compound in Comparative Example 2.

Dispersion was carried out in the same manner as in Example 1 except that the AP product of the imidazole perylene compound was replaced with the sublimated product thereof, to obtain a dispersion. The X-ray diffraction spectrum of the dispersion obtained was measured, the results of which were as shown in FIG. 10. The half width of the peak at 12.4°±0.2° was 0.68°, and the intensity of the peak at 27.1°±0.2° was larger than that of the peak at 12.4°±0.2°. Using this dispersion, a photoreceptor was produced in the same manner as in Example 1.

This photoreceptor is designated as Comparative Sample (2).

Comparative Example 3

Figure 11:
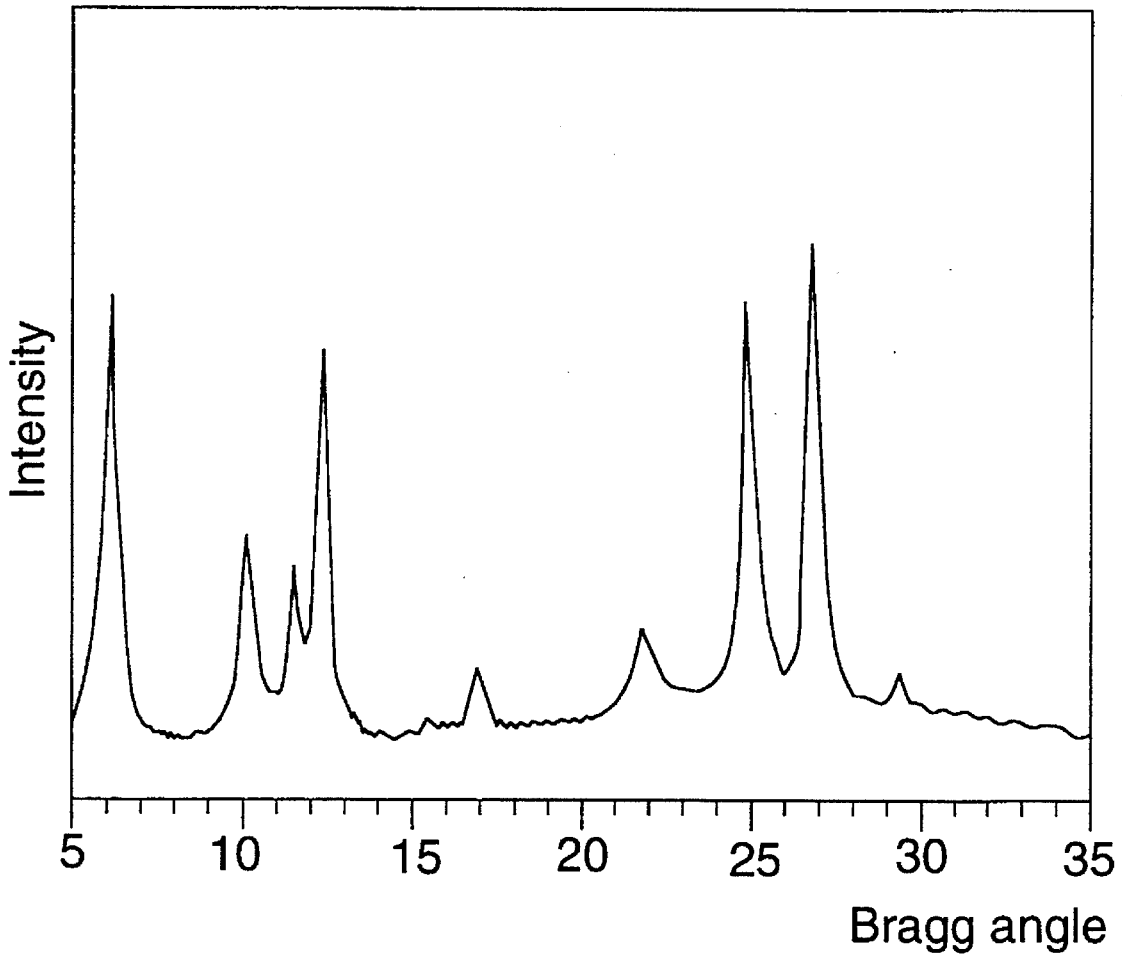
FIG. 11 is an X-ray diffraction spectrum of the imidazole perylene compound in Comparative Example 3.

Dispersion was carried out in the same manner as in Example 1 except that the AP product of the imidazole perylene compound was replaced with the sublimated product thereof, the polyvinyl butyral resin was replaced with polycarbonate resin PANLITE 1250 (trade name; available from Teijin Chemicals Ltd.) and the methyl ethyl ketone was replaced with toluene. The X-ray diffraction spectrum of the dispersion obtained was measured, which was as shown in FIG. 11. The half width of the peak at 12.4°±0.2° was 0.52°, and the intensity of the peak at 27.1°±0.2° was larger than that of the peak at 12.4°±0.2°. A peak was also seen at 11.5°±0.2°. Using this dispersion, a photoreceptor was produced in the same manner as in Example 1.

This photoreceptor is designated as Comparative Sample (3).

Evaluation 1

The samples thus obtained were evaluated in the following manner, using a paper analyzer EPA-8100 (manufactured by Kawaguchi Denki K.K.). First, the samples were each corona-charged for 5 seconds under conditions of −6 kV, where surface potential Va right after charging and surface potential Vi after leaving for 5 seconds were determined, and subsequently subjected to exposure in a surface illuminance of 2 lux, where the amount of exposure E600/100 necessary for dropping the surface potential from −600 V to −100 V. The rate of dark decay D was also found according to an equation of D=100 (Va−Vi)/Va (%). Results obtained were as shown in Table 1.

TABLE 1

| | X-ray diffraction spectra | | | Evaluation 1 | |
|---|---|---|---|---|---|
| Photo-receptor | Half width (deg) | 11.5° peak | 12.4° peak | E600/100 (lux · sec) | D (%) |
| Sample 1 | 0.86 | None | Maximum | 2.2 | 15.4 |
| Sample 2 | 0.94 | None | Maximum | 2.4 | 16.6 |
| Sample 3 | 0.68 | None | Maximum | 2.4 | 17.0 |
| Comparative Sample (1) | 0.60 | Seen | Maximum | 5.0 | 24.5 |
| Comparative Sample (2) | 0.68 | None | Not maximum | 4.5 | 22.1 |
| Comparative Sample (3) | 0.52 | Seen | Not maximum | 5.3 | 25.7 |

Examples 4 to 13

Photoreceptors were produced in the same manner as in Example 1 except that the carrier transportation material B-23 was replaced with B-21, B-8, B-13, B-43, B-46, C-5, C-9, D-4, D-15 and E-7, respectively.

These are designated as Samples 4 to 13.

Comparative Examples 4 to 7

Photoreceptors were produced in the same manner as in Example 1 except that the carrier transportation material B-23 was replaced with compounds of the following structures Z-1, Z-2, Z-3 and Z-4, respectively.

These are designated as Comparative Samples (4) to (7).

Comparative Example 8

A photoreceptor was produced in the same manner as in Example 1 except that the AP product of imidazole perylene compound was replaced with a dry process pulverized product obtained by pulverizing the sublimated product thereof by the dry process in a ball mill for 72 hours, and the carrier transportation material B-23 was replaced with the compound Z-1.

This is designated as Comparative Sample (8).

The X-ray diffraction spectrum of the dispersion was also measured. As a result, the intensity of the peak at 12.4°±0.2° was maximum, and the half width of it was 0.67°. No clear peak was also seen at 11.5±0.2°.

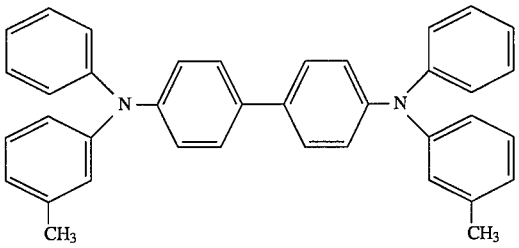

(Z-1)

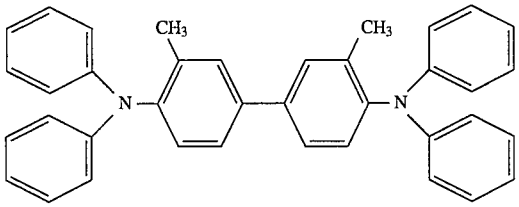

(Z-2)

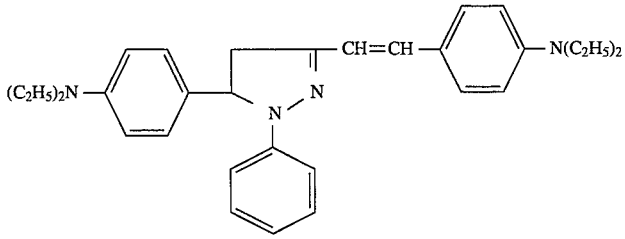

(Z-3)

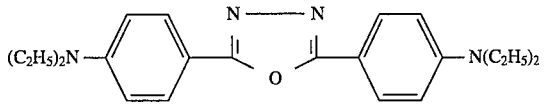

(Z-4)

Evaluation 2

The samples thus obtained were evaluated in the same manner as in Evaluation 1, and thereafter fitted to a modified machine of a copying machine U-BIX 3035 (trade name; manufactured by Konica Corporation) to make evaluation of images in a 10,000 time running test.

Results obtained are shown in Table 2.

TABLE 2

| Photo-receptor | Carrier transportation material | Evaluation 1 E600/100 (lux · sec) | Evaluation 1 D (%) | Evaluation 2 Faulty images |
|---|---|---|---|---|
| Sample 4 | B-21 | 2.4 | 16.1 | None |
| Sample 5 | B-8 | 2.6 | 15.2 | None |
| Sample 6 | B-13 | 2.3 | 15.5 | None |
| Sample 7 | B-43 | 2.2 | 16.5 | None |
| Sample 8 | B-46 | 2.0 | 17.0 | None |
| Sample 9 | C-5 | 3.5 | 19.5 | None |
| Sample 10 | C-9 | 3.3 | 19.1 | None |
| Sample 11 | D-4 | 3.4 | 16.8 | None |
| Sample 12 | D-15 | 3.6 | 17.5 | None |
| Sample 13 | E-7 | 3.3 | 19.8 | None |
| Comparative Sample (4) | Z-1 | 4.2 | 21.1 | Cracked images |
| Comparative Sample (5) | Z-2 | 4.4 | 22.0 | Cracked images |
| Comparative Sample (6) | Z-3 | 8.1 | 24.5 | Fogged |
| Comparative Sample (7) | Z-4 | 9.6 | 23.3 | Fogged |
| Comparative Sample (8) | Z-1 | 4.2 | 36.2 | Black dots & Cracked images |

In the foregoing Examples and Comparative Examples, it has been ascertained that the X-ray diffraction spectra of the imidazole perylene compounds, measured on those obtained from the photoreceptor samples, are in agreement with the X-ray diffraction spectra of the samples obtained by evaporating corresponding dispersions to dryness. Thus, the imidazole perylene compound shows very superior sensitivity characteristics when present in the photosensitive layer in the specific crystalline state as defined in the present invention.

Example 14

Production of photoreceptor 14-1 (Inventive):

In a mixed solvent of 900 ml of methanol and 100 ml of 1-butanol, 30 g of a copolymer polyamide resin CM-8000 (trade name; available from Toray Industries, Inc.) was poured and dissolved. Using the resulting solution, a mirror-finished aluminum drum of 80 mm outer diameter and 355.5 mm long was dip-coated with it to form a 0.5 μm thick intermediate layer on its surface. Subsequently, 6 g of polyvinyl butyral resin S-LEC BLS (trade name; available from Sekisui Chemical Co., Ltd.) was dissolved in 1,000 ml of methyl ethyl ketone (available from Kanto Chemical Co., Inc.) and 28 g of an AP product of the exemplary compound A-1 obtained by the method previously described was further mixed therein, followed by dispersion for 15 hours using a sand mill together with 2,000 g of glass beads of 1 mm diameter to obtain a dispersion 1. Using this dispersion, a 0.5 μm thick carrier generation layer was formed on the imidazole perylene compound by dip coating.

The dispersion obtained here was coated on a glass plate several times, followed by drying to prepare a dry film having a thickness of about 200 μm, and the X-ray diffraction spectrum was measured under radiation of Cu-Kα rays. As a result, the compound was found to be crystals having peaks at 2θ=6.3°, 12.4°, 25.3° and 27.1° in the Bragg angle (2θ±0.2°), showing a maximum intensity at the peak of 12.4°, the peak having a half width of 0.86°, and no clear peak being present at 11.5°.

Thereafter, 200 g of the following compound T and 200 g of the following polymer B were dissolved in 1,000 ml of dichloromethane (available from Kanto Chemical Co., Inc.). Using the resulting solution, a 20 μm thick carrier transportation layer was formed on the carrier generation layer by dip coating.

Figure 12:
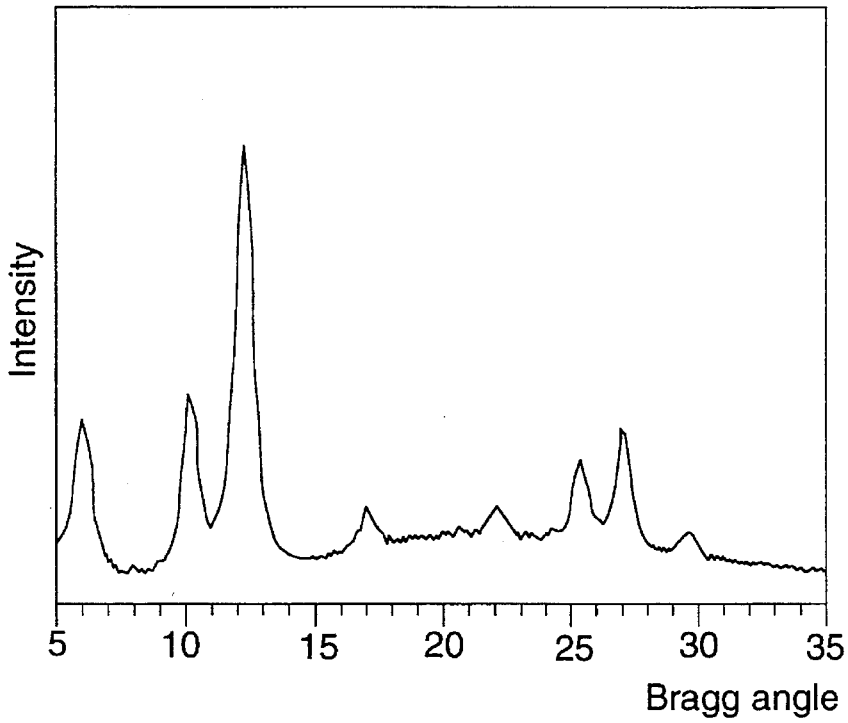
FIG. 12 is an X-ray diffraction spectrum within the scope of the present invention.

Finally, the product was dried by heating at 100° C. for 1 hour. Thus, a photoreceptor 14-1 having the intermediate layer, the carrier generation layer and the carrier transportation layer which were superposed in this order was produced. The above X-ray diffraction spectrum was as shown in FIG. 12.

B:

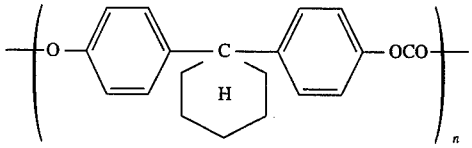

-continued

T:

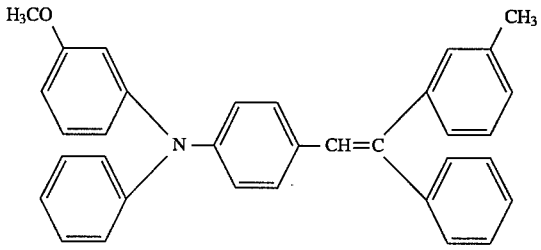

Production of photoreceptor 14-2 (Inventive):

A photoreceptor 14-2 was produced in the same manner as the production of photoreceptor 14-1 except that the carrier generation layer was formed using a dispersion 2 obtained by using 1,2-dichloroethane in place of the solvent methyl ethyl ketone of the dispersion 1 and also carrying out dispersion for 20 hours using 2,500 g of the glass beads in the dispersing sand mill, and, as shown in Table 4, the polyamide resin CM-8000 of the intermediate layer was replaced with a modified polyamide resin LUCKAMIDE 5003 (trade name; available from Dainippon Kagaku Kogyo K.K.).

The X-ray diffraction spectrum of the dispersion 2 was measured to find that, as shown in Table 3, the intensity of the peak at 12.4°±0.2° was maximum, the half width of the peak was 0.94°, and no clear peak was seen at 11.5°±0.2°.

Production of photoreceptor 14-3 (Inventive):

A photoreceptor 14-3 was produced in the same manner as the production of photoreceptor 14-1 except that the carrier generation layer was formed using a dispersion 3 obtained by using tetrahydrofuran in place of the solvent methyl ethyl ketone of the dispersion 1 and also carrying out dispersion for 10 hours using 1,500 g of the glass beads in the dispersing sand mill. The X-ray diffraction spectrum of the dispersion 3 was measured to find that the intensity of the peak at 12.4°+0.2° was maximum, the half width of the peak was 0.68°, and no clear peak was seen at 11.5°+0.2°.

Production of photoreceptor 14-4 (Comparative):

A photoreceptor 14-4 was produced in the same manner as the production of photoreceptor 14-1 except that as shown in Table 4 the polyamide resin CM-8000 of the intermediate layer of the photoreceptor 1 was replaced with a polyvinyl butyral resin S-LEC BH-3 (trade name; available from Sekisui Chemical Co., Ltd.)

Production of photoreceptor 14-5 (Comparative):

A photoreceptor 14-5 was produced in the same manner as the production of photoreceptor 14-1 except that the AP product of the exemplary compound A-1 contained in the dispersion 1 was replaced with a dispersion 4 containing a perylene pigment G2 having the following structure.

G2:

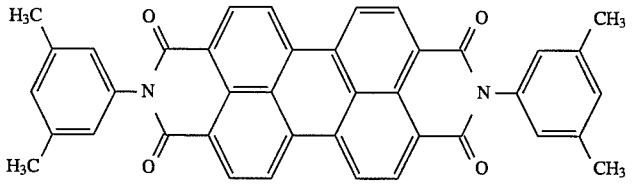

Production of photoreceptor 14-6 (Comparative):

A photoreceptor 14-6 wag produced in the same manner as the production of photoreceptor 14-1 except that as shown in Table 4 the intermediate layer was not provided.

Production of photoreceptor 14-7 (Comparative):

A photoreceptor 14-7 was produced in the same manner as the production of photoreceptor 14-1 except for using a dispersion 5 prepared by carrying out dispersion for 5 hours using an ultrasonic dispersion machine in place of the sand mill, the dispersion means for preparing the dispersion 1.

The X-ray diffraction spectrum of the dispersion 5 was measured to find that, as shown in Table 3, the intensity of the peak at 12.4°±0.2° was maximum, the half width of the peak was 0.60°, and also a clear peak was seen at 11.5°±0.2°.

Production of photoreceptor 14-8 (Comparative):

A photoreceptor 14-8 was produced in the same manner as the production of photoreceptor 14-1 except for using a dispersion 6 containing a sublimated product (SUB) of the exemplary compound A-1 in place of the AP product of the exemplary compound A-1 contained in the dispersion 1.

The X-ray diffraction spectrum of the dispersion 6 was measured to find that, as shown in Table 3, no maximum intensity was seen at the peak of 12.4°±0.2° but a maximum intensity was seen at a peak of 27.1°±0.2°, and the half width of the peak at 12.4°±0.2° was 0.68°, and also no clear peak was seen at 11.5°±0.2°.

Figure 13:
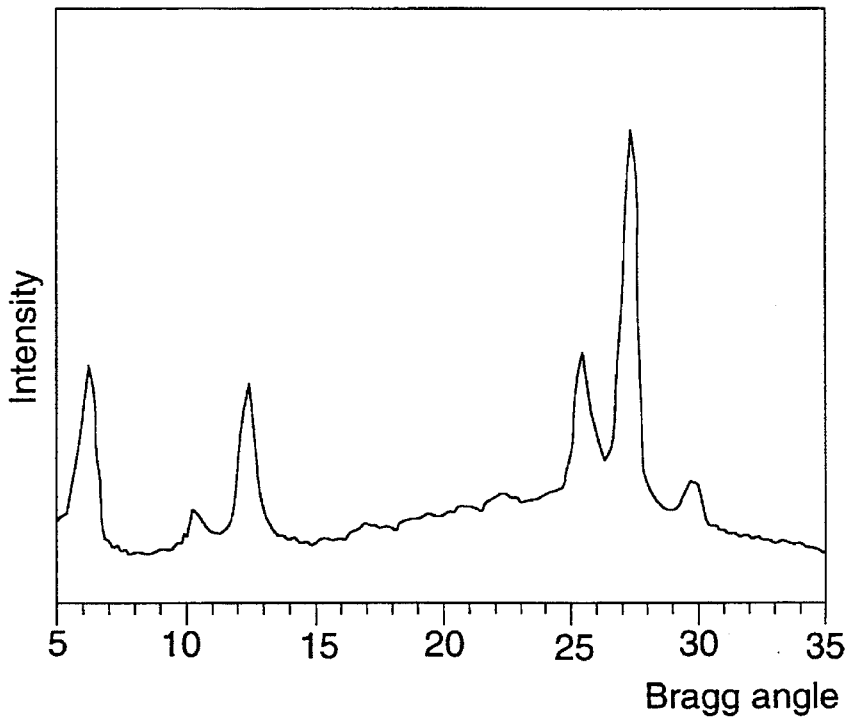
FIG. 13 is an X-ray diffraction spectrum outside the scope of the present invention.

This X-ray diffraction spectrum is shown in FIG. 13.

Production of photoreceptor 14-9 (Comparative):

A photoreceptor 14-9 was produced in the same manner as the production of photoreceptor 14-1 except for using a dispersion 7 containing a sublimated product (SUB) of the exemplary compound A-1 in place of the AP product of the exemplary compound A-1 contained in the dispersion 1, and containing a 1:1 mixed solvent of toluene and isopropyl alcohol in place of the dispersion medium methyl ethyl ketone.

The X-ray diffraction spectrum of the dispersion 7 was measured to find that, as shown in Table 3, a maximum intensity was seen at a peak of 27.1°±0.2°, the half width of the peak at 12.4°±0.2° was 0.52°, and also a clear peak was seen at 11.5°±0.2°.

Production of photoreceptor 14-10 (Inventive):

A photoreceptor 14-10 was produced in the same manner as the production of photoreceptor 14-1 except that the carrier transportation material used in the photoreceptor 14-1 was replaced with C-5.

Production of photoreceptor 14-11 (Inventive):

A photoreceptor 14-11 was produced in the same manner as the production of photoreceptor 14-1 except that the carrier transportation material used in the photoreceptor 14-1 was replaced with D-4.

Production of photoreceptor 14-12 (Inventive): A photoreceptor 14-12 was produced in the same manner as the production of photoreceptor 14-1 except that the carrier transportation material used in the photoreceptor 14-1 was replaced with E-7.

C-5

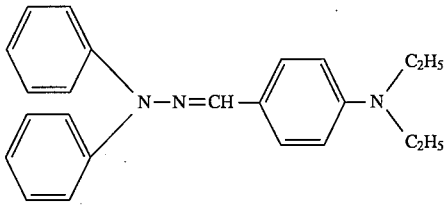

D-4

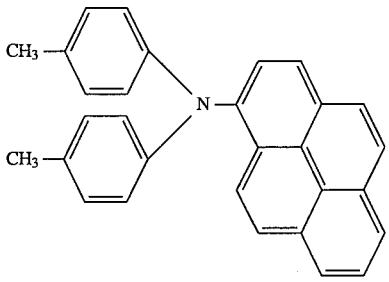

E-7

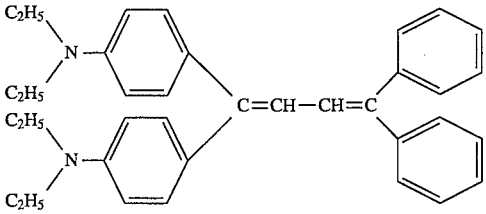

TABLE 3(A)

| Dispersion No. | X-ray dif. spectrum | Crystal form characteristics: Peak at 11.5° | Maximum peak | Half width |
|---|---|---|---|---|
| 1 | FIG. 1 | None | 12.4° | 0.86° |
| 2 | — | None | 12.4° | 0.94° |
| 3 | — | None | 12.4° | 0.68° |
| 4 | — | — | — | — |
| 5 | — | Seen | 12.4° | 0.60° |
| 6 | FIG. 2 | None | 27.1° | 0.68° |
| 7 | — | Seen | 27.1° | 0.52° |

TABLE 3(B)

| Dispersion No. | Dispersion conditions: Carrier generation material | Solvent | Dispersing |
|---|---|---|---|
| 1 | AP product of A-1 | Methyl ethyl ketone | Sand mill; Beads: 2,000 g; for 15 hrs |
| 2 | AP product of A-1 | 1,2-Dichloroethane | Sand mill; Beads: 2,500 g; for 20 hrs |
| 3 | AP product of A-1 | Tetrahydrofuran | Sand mill; Beads: 1,500 g; for 10 hrs |
| 4 | Perylene Pigment G2 | Methyl ethyl ketone | Sand mill; Beads: 2,000 g; for 15 hrs |
| 5 | AP product of A-1 | Methyl ethyl ketone | Ultrasonic dispersion; for 5 hrs |
| 6 | SUB product of A-1 | Methyl ethyl ketone | Sand mill; Beads: 2,000 g; for 15 hrs |
| 7 | SUB product of A-1 | Toluene + Isopropyl alcohol | Sand mill; Beads: 2,000 g; for 15 hrs |

TABLE 4

| Photoreceptor No. | Dispersion No. | Intermediate layer |
|---|---|---|
| 14-1 (Example) | 1 | Polyamide, CM-8000 (Toray) |
| 14-2 (Example) | 2 | Polyamide, LUCKAMIDE 5003 (Dainippon Ink) |
| 14-3 (Example) | 3 | Polyamide, CM-8000 |
| 14-4 (Comparative Example) | 1 | Polyvinyl butyral, S-LEC BH-3 (Sekisui) |
| 14-5 (Comparative Example) | 4 | Polyamide, CM-8000 |
| 14-6 (Comparative Example) | 1 | No intermediate layer |
| 14-7 (Comparative Example) | 5 | Polyamide, CM-8000 |
| 14-8 (Comparative Example) | 6 | Polyamide, CM-8000 |
| 14-9 (Comparative Example) | 7 | Polyamide, CM-8000 |
| 14-10 (Example) | 1 | Polyamide, CM-8000 (Toray) |
| 14-11 (Example) | 1 | Polyamide, CM-8000 (Toray) |
| 14-12 (Example) | 1 | Polyamide, CM-8000 (Toray) |

Evaluation:

The photoreceptors Nos. 1 to 12 were each set on a modified machine of U-BIX 4155, manufactured by Konica Corporation, and image evaluation was made on 100,000 copy sheets in an environment of temperature 22° C. and relative humidity 60% RH. The surface potential of each photoreceptor was also measured in environments of temperature 33° C. and relative humidity 80% RH and temperature 10° C. and relative humidity 20% RH, to make evaluation on variations of surface potential according to environments.

Results obtained are shown in Table 5.

TABLE 5

| | Photoreceptor | | | | | | | | | |
|---|---|---|---|---|---|---|---|---|---|---|
| | Surface potential (22° C., 60% RH) | | | | Surface potential | | | | | |
| | Initial Stage | | After 10,000 sh. | | 33° C., 80% RH | | 10° C., 20% RH | | | |
| Sample No. | Vb (V) | Vw (V) | Vb (V) | Vw (V) | Vb (V) | Vw (V) | Vb (V) | Vw (V) | (1) | Remarks |
| 14-1 | −725 | −45 | −725 | −65 | −720 | −40 | −730 | −60 | A | Inv. |
| 14-2 | −730 | −50 | −735 | −80 | −715 | −40 | −740 | −70 | A | Inv. |
| 14-3 | −735 | −55 | −720 | −75 | −720 | −40 | −745 | −75 | A | Inv. |
| 14-4 | −705 | −70 | −705 | −190 | −685 | −50 | −740 | −95 | B1 | Comp. |
| 14-5 | −735 | −120 | −715 | −220 | −720 | −90 | −745 | −150 | B2 | Comp. |
| 14-6 | −690 | −40 | −670 | −75 | −670 | −30 | −710 | −60 | C | Comp. |
| 14-7 | −710 | −50 | −720 | −85 | −700 | −45 | −720 | −80 | C | Comp. |
| 14-8 | −720 | −100 | −710 | −140 | −705 | −85 | −730 | −120 | B3 | Comp. |
| 14-9 | −715 | −110 | −705 | −150 | −700 | −90 | −730 | −135 | B2 | Comp. |
| 14-10 | −740 | −65 | −745 | −90 | −730 | −50 | −745 | −85 | A | Inv. |
| 14-11 | −765 | −75 | −770 | −95 | −750 | −65 | −765 | −90 | A | Inv. |
| 14-12 | −725 | −650 | −730 | −850 | −720 | −50 | −735 | −80 | A | Inv. |

Inv.: Inventive
Comp.: Comparison
(1): Image characteristics
A: Good throughout 100,000 sheet running.
B1: Fog occurred after 5,000 sheet running.
B2: Fog occurred after 10,000 sheet running.
B3: Fog occurred after 80,000 sheet running.
C: White dots occurred at the initial stage and thereafter.

In Table 5, $V_b$ or $V_w$ represents photoreceptor surface potential with respect to an original with a reflection density of 1.3 (black paper) or 0.00 (white paper), respectively.

Example 15

(1) Preparation of support:

Giving an order to a manufacturer for materials, seventeen untreated aluminum pipes of 60 mm diameter and 273 mm long having the surface roughness characteristics as shown in Table 6 were obtained. These untreated aluminum pipes were prepared by the manufacturer in the following way: First, crude aluminum pipes were produced by hot extrusion by means of a direct extruder, and these crude aluminum pipes were cold-drawn by means of a drawing machine to improve their dimensional precision and thus formed into the untreated aluminum pipes. The latter treatment is usually called as ironing treatment.

(2) Formation of intermediate layer:

In 1,000 ml of a mixed solvent of methanol and n-butanol (weight ratio: methanol:n-butanol=4:1), 15 g of a polyamide resin CM-8000 (trade name; available from Toray Industries, Inc.) was dissolved to prepare a coating solution.

Using the above coating solution, a layer was formed on the support by dip coating in the thickness as shown in Table 6, to obtain fifteen photoreceptor supports having intermediate layers.

(3) Formation of photosensitive layer:

(i) Formation of carrier generation layer:

Using a solution prepared by dispersing 75 g of the exemplified compound A-1 and 1.5 g of a polyvinyl butyral resin S-LEC BX-L (trade name; available from Sekisui Chemical Co., Ltd.) in 3,000 ml of methyl ethyl ketone by means of a sand grinder, a carrier generation layer (CGL) was formed on the support or intermediate layer by dip coating in a thickness of 0.5 μm as shown in Table 6.

As shown in Table 6, in respect of only two drums, the carrier generation layer was formed in the same manner as in the above layer formation except that the exemplified compound A-1 used as the carrier generation material (CGM) was replaced with a perylene compound (I) shown below.

Perylene compound (I):

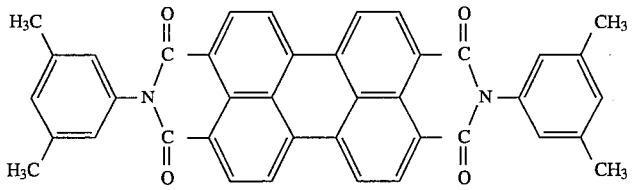

(ii) Formation of carrier transportation layer:

Using a solution comprised of 165 g of a bisphenol-Z type polycarbonate resin IUPILON Z300 (trade name; available from Mitsubishi Gas Chemical Company, Inc.) 1,328 g of a carrier transportation material shown below (T-1 or T-2) and 1,000 ml of dichloroethane, a carrier transportation layer of 30 μm thick was formed on the carrier generation layer by dip coating (drying: 90° C. for 1 hour).

T-1

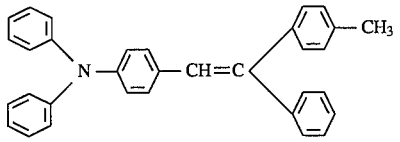

T-2

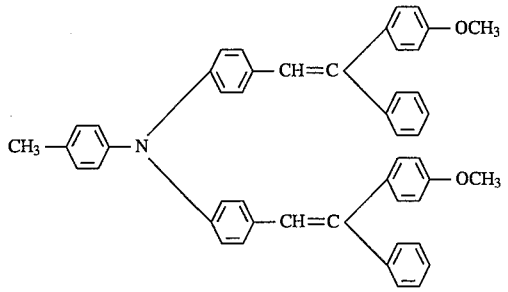

Sixteen photoreceptors thus produced are summarized as shown in Table 6.

TABLE 6

| Photo-receptor No. | Support surface roughness Rp (μm) | Support surface roughness Rmax (μm) | Intermediate layer (μm) | Carrier generation material | Carrier transportation material |
|---|---|---|---|---|---|
| 1-1 (Y) | 0.12 | 0.25 | 0.2 | A-1 | T-1 |
| 1-2 (Y) | 0.12 | 0.25 | 0.2 | A-1 | T-2 |
| 1-3 (Y) | 0.5 | 0.9 | 0.2 | A-1 | T-2 |
| 1-4 (Y) | 0.8 | 1.6 | 0.2 | A-1 | T-2 |
| 1-5 (Y) | 0.24 | 0.60 | 0.2 | A-1 | T-2 |
| 1-6 (Y) | 0.24 | 0.60 | 0.4 | A-1 | T-1 |
| 1-8 (Y) | 0.24 | 0.60 | 0.05 | A-1 | T-1 |
| 1-1 (X) | 0.12 | 0.25 | 0.2 | Comp. (I) | T-1 |
| 1-2 (X) | 0.24 | 0.60 | 0.2 | Comp. (I) | T-2 |
| 1-3 (X) | 0.04 | 0.10 | 0.2 | A-1 | T-2 |
| 1-4 (X) | 0.1 | 0.15 | 0.2 | A-1 | T-2 |
| 1-5 (X) | 0.1 | 0.15 | 0.2 | Comp. (I) | T-2 |
| 1-6 (X) | 0.90 | 1.60 | 0.2 | A-1 | T-1 |
| 1-7 (X) | 0.90 | 1.60 | 0 (none) | A-1 | T-1 |
| 1-8 (X) | 0.96 | 1.72 | 0.2 | A-1 | T-1 |
| 1-9 (X) | 0.73 | 1.72 | 0.2 | A-1 | T-1 |

Y: Inventive sample
X: Comparative Sample

Image evaluation test:

The photoreceptors as shown in Table 6 were each incorporated in an electrophotographic copying machine LIPS-10 (trade name, manufactured by Konica Corporation), and a black paper chart was actually copied.

Evaluation concerning blank areas on images was made as follows: Using an image analyzer OMNICON 3000 TYPE (trade name, manufactured by Shimadzu Corporation), the diameters and number of blank areas were measured, and judgement was made on how many blank areas with a diameter of 0.3 mm or larger are present per 1 $cm^2$.

Evaluation concerning density decrease was made by measuring the image density using a reflection densitometer. Evaluation concerning interference fringes was made by visual observation of actual copies of a halftone chart.

Evaluation on faulty images:

AA: Image density is 1.3 or more, and no (zero) blank areas of 0.3 mm or larger diameter are seen (in A4-size paper).

A: Image density is 1.2 or more, and not more than five blank areas of 0.3 mm or larger to smaller than 0.5 mm diameter and no (zero) blank areas of 0.5 mm or larger diameter are seen (in A4-size paper).

C: Image density is 1.2 or more, and six or more blank areas of 0.3 mm or larger diameter are seen (in A4-size paper); or image density is 1.2 or less, and five or less blank areas of smaller than 0.5 mm diameter are seen (in A4-size paper).

CC: Image density is 1.2 or more, and six or more blank areas of 0.3 mm or larger diameter are seen (in A4-size paper).

B: Intermediate between A and C.

Running performance test:

Using a copying machine obtained by modifying the above copying machine to have a surface potentiometer, a process of from charging to exposure and up to charge elimination was repeated 10,000 times, where black paper potential, white paper potential (Vb and Vw, respectively) and residual potential were measured at the first copying and 10,000th copying. The black paper potential means a surface potential on the drum, measured when an original with a density of 1.30 is copied, and the white paper potential means a surface potential on the drum, measured when an original with a density of 0.00 is copied. Residual potential Vr was also measured.

Results obtained are shown in Table 7.

TABLE 7

| Photo-receptor No. | Faulty images: First copying (1) | First copying (2) | 10,000th copying (1) | 10,000th copying (2) | Running performance: First copying Vb (−V) | First copying Vw (−V) | First copying Vr (−V) | 10,000th copying Vb (−V) | 10,000th copying Vw (−V) | 10,000th copying Vr (−V) |
|---|---|---|---|---|---|---|---|---|---|---|
| 1-1 (Y) | No | AA | No | AA | 730 | 77 | 10 | 712 | 92 | 27 |
| 1-2 (Y) | No | AA | No | AA | 727 | 68 | 6 | 715 | 80 | 15 |
| 1-3 (Y) | No | AA | No | AA | 725 | 66 | 7 | 712 | 81 | 14 |
| 1-4 (Y) | No | AA | No | AA | 718 | 68 | 6 | 710 | 81 | 15 |
| 1-5 (Y) | No | AA | No | AA | 623 | 65 | 6 | 717 | 78 | 13 |
| 1-6 (Y) | No | AA | No | AA | 720 | 78 | 15 | 709 | 90 | 28 |
| 1-8 (Y) | No | AA | No | AA | 732 | 79 | 12 | 720 | 89 | 27 |
| 1-1 (X) | No | C | No | CC | 698 | 213 | 52 | 590 | 297 | 132 |
| 1-2 (X) | No | C | No | CC | 700 | 156 | 38 | 587 | 212 | 92 |
| 1-3 (X) | x* | A | x* | C | 725 | 70 | 7 | 715 | 82 | 17 |
| 1-4 (X) | x* | A | x* | C | 732 | 73 | 7 | 720 | 85 | 16 |
| 1-5 (X) | x* | CC | x* | CC | 691 | 224 | 60 | 578 | 305 | 142 |
| 1-6 (X) | No | C | No | CC | 713 | 83 | 17 | 700 | 98 | 30 |
| 1-7 (X) | No | CC | No | CC | 720 | 80 | 15 | 705 | 95 | 27 |
| 1-8 (X) | No | C | No | CC | 717 | 85 | 17 | 702 | 99 | 32 |
| 1-9 (X) | No | B | No | CC | 718 | 84 | 16 | 701 | 96 | 33 |

(1): Interference fringes;
(2): White areas
Y: Inventive sample;
X: Comparative sample;
x*: Seen As is seen from the results shown in Table 7, the samples of the present invention, compared with comparative samples, are photoreceptors that cause no faulty images such as white areas and interference fringes, show superior charging performance, cause no lowering of charge potential also after their repeated use in 10,000 time running and cause no rise of residual potential, even though the untreated aluminum pipes having rough surfaces are used.

Example 16

Production of photoreceptor 2-1:

In 1,000 ml of a mixed solvent of methanol and n-butanol (4:1), 15 g of a polyamide resin CM-8000 (trade name; available from Toray Industries, Inc.) was put and dissolved with heating. The resulting solution was cooled to room temperature. Thereafter, using this solution, an intermediate layer of 0.2 μm thick was formed by dip coating on an untreated aluminum pipe of 60 mm diameter and 273 mm long.

The above untreated aluminum pipe was one of those prepared by the manufacturer in the following way: First, crude aluminum pipes were produced by hot extrusion by means of a direct extruder, and these were cold-drawn by means of a drawing machine to improve their dimensional precision, i.e., to carry out what is called ironing, so as to have a ten-point surface roughness Rz of 0.25.

Subsequently, 6 g of a polyvinyl butyral resin S-LEC BLS (trade name; available from Sekisui Chemical Co., Ltd.) was dissolved in 1,000 ml of methyl ethyl ketone (available from Kanto Chemical Co., Inc.), and 28 g of the AP product of exemplary compound A-1 obtained by the method shown in Example 1 was further mixed as the carrier generation material (CGM), followed by dispersion for 15 hours using a sand mill (SG) together with 2,000 g of glass beads of 1 mm diameter. A dispersion 1 was thus obtained.

Using this dispersion, a 0.5 μm thick carrier generation layer (CGL) was formed on the above intermediate layer by dip coating.

The dispersion obtained here was coated on a glass plate several times, followed by drying to prepare a dry film having a thickness of about 200 μm, and the X-ray diffraction spectrum was measured under radiation of Cu-Kα rays. As a result, the crystals were found to have peaks at 6.3°±0.2°, 12.4°±0.2°, 25.3°±0.2° and 27.1°±0.2° in the Bragg angle 2θ, showing a maximum intensity at the peak of 12.4° as shown in Table 8, the peak having a half width of 0.86°, and no clear peak being present at 11.5°.

Thereafter, on this CGL, a coating solution prepared by dissolving 132 g of a carrier transportation material (CTM), compound T-1 having the structure previously shown, and 165 g of a bisphenol-Z polycarbonate resin Z-200 (trade name; available from Mitsubishi Gas Chemical Company, Inc.) in 1,000 ml of 1,2-dichloroethane was dip-coated to form a carrier transportation layer (CTL), followed by drying at 100° C. for 1 hour. Thus, a photoreceptor 2-1 as shown in Table 9, having the intermediate layer, the CGL and the CTL.

Figure 16:
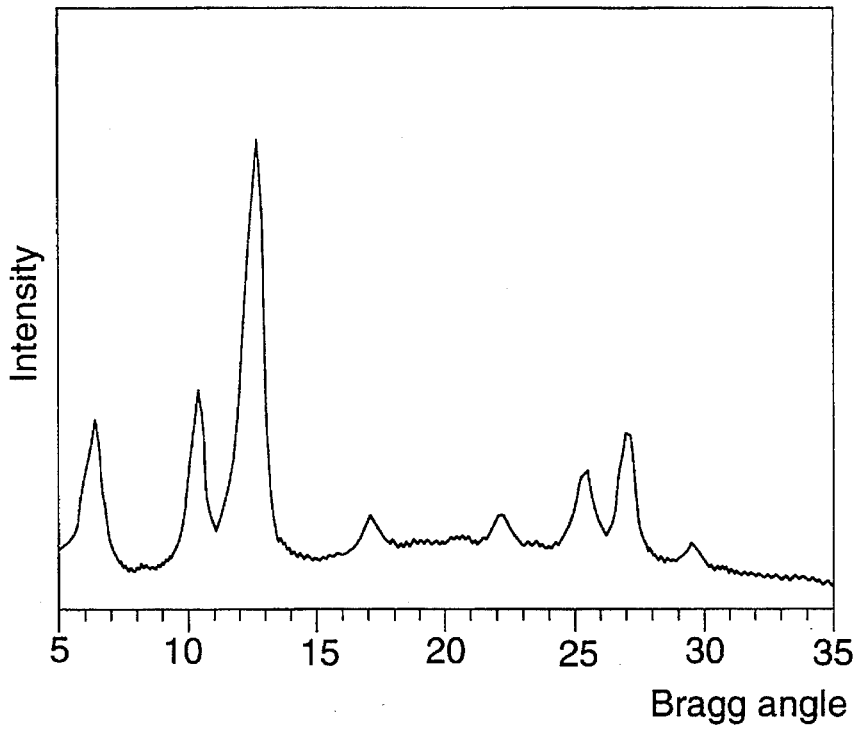
FIG. 16 is an X-ray diffraction spectrum of the compound within the scope of the present invention.

The X-ray diffraction spectrum of the above dispersion is shown in FIG. 16.

Production of photoreceptor 2-2:

A photoreceptor 2-2 (Example 16-2) as shown in Table 9 was produced in the same manner as in the production of the photoreceptor 1 except that the conductive support comprised of the untreated aluminum pipe as used in photoreceptor 2-1 was made to have a ten-point surface roughness Rz of 0.80.

Production of photoreceptor 2-3:

A photoreceptor 2-3 (Example 16-3) as shown in Table 9 was produced in the same manner as in the production of the photoreceptor 2-1 except that the conductive support comprised of the untreated aluminum pipe as used in photoreceptor 2-1 was made to have a ten-point surface roughness Rz of 1.45.

Production of photoreceptor 2-4:

A photoreceptor 2-4 (Example 16-4) as shown in Table 9 was produced in the same manner as in the production of the photoreceptor 2-2 except that a dispersion 2 was obtained by using 1,2-dichloroethane in place of the solvent methyl ethyl ketone of the dispersion 1 and also carrying out dispersion for 20 hours using 2,500 g of the glass beads in the dispersing sand mill, and the carrier generation layer (CGL) was formed using this dispersion 2.

The X-ray diffraction spectrum of the dispersion 2 was measured in the same manner as in the case of the photoreceptor 2-1 to find that, as shown in Table 8, the intensity of the peak at 12.4°±0.2° was maximum, the half width of the peak was 0.94°, and no clear peak was seen at 11.5°±0.2°.

Production of photoreceptor 2-5:

A photoreceptor 2-5 (Example 16-5) as shown in Table 9 was produced in the same manner as the production of photoreceptor 2-2 except that a dispersion 3 was obtained by using tetrahydrofuran in place of the solvent methyl ethyl ketone of the dispersion 1 and also carrying out dispersion for 10 hours using 1,500 g of the glass beads in the dispersing sand mill, and the carrier generation layer was formed using this dispersion 3.

The X-ray diffraction spectrum of the dispersion 3 was measured in the same manner as in the case of the photoreceptor 2-1 to find that the intensity of the peak at 12.4°±0.2° was maximum, the half width of the peak was 0.68°, and no clear peak was seen at 11.5°±0.2°.

Production of photoreceptor 2-6:

A photoreceptor 2-6 (Example 16-6) as shown in Table 9 was produced in the same manner as the production of photoreceptor 2-2 except that the copolymer type polyamide resin CM-8000 of the intermediate layer of the photoreceptor 2-2 was replaced with a modified polyamide resin LUCKAMIDE 5003 (trade name; available from Dainippon Kagaku Kogyo K.K.).

Production of photoreceptor 2-7:

A photoreceptor 2-7 (Example 16-7) as shown in Table 9 was produced in the same manner as the production of photoreceptor 2-2 except that the compound T-1 of the carrier transportation material in the carrier transportation layer of the photoreceptor 2-2 was replaced with the compound T-2 having the structure previously shown.

Production of photoreceptor 2-8:

A photoreceptor 2-8 (Example 16-8) as shown in Table 9 was produced in the same manner as the production of photoreceptor 2-2 except that the intermediate layer of the photoreceptor 2-2 was formed in a layer thickness of 0.4 μm in place of 0.2 μm.

Production of photoreceptor 2-9:

A photoreceptor 2-9 (Example 16-9) as shown in Table 9 was produced in the same manner as the production of photoreceptor 2-2 except that the intermediate layer of the photoreceptor 2-2 was formed in a layer thickness of 0.05 μm in place of 0.2 μm.

Production of photoreceptor 2-10:

A dispersion 4 was prepared in the same manner as in the preparation of the dispersion 1 except that the dispersion was carried out for 5 hours using an ultrasonic dispersion machine (US) in place of the sand mill, the dispersion means for preparing the dispersion 1. A photoreceptor 2-10 (Comparative Example 10-1) as shown in Table 9 was produced in the same manner as the production of photoreceptor 2-7 except that the dispersion 1 was replaced with the dispersion 4.

The X-ray diffraction spectrum of the dispersion 5 was measured in the same manner as in the case of the photoreceptor 1 to find that, as shown in Table 8, the intensity of the peak at 12.4°±0.2° was maximum, the half width of the peak was 0.60°, and also a clear peak was seen at 11.5°±0.2°.

Production of photoreceptor 2-11:

A dispersion 5 was prepared in the same manner as in the preparation of the dispersion 1 except that the AP product of the exemplary compound A-1 contained in the dispersion 1 was replaced with a sublimated product (SUB) of the exemplary compound A-1. A photoreceptor 2-11 (Comparative Example 10-2) as shown in Table 9 was produced in the same manner as the production of photoreceptor 2-7 except that the dispersion 1 was replaced with the dispersion 5.

The X-ray diffraction spectrum of the dispersion 6 was measured in the same manner as in the case of the photoreceptor 2-7 to find that, as shown in Table 3, no maximum intensity was seen at the peak of 12.4°±0.2° but a maximum intensity was seen at a peak of 27.1°±0.2°, and the half width of the peak at 12.4°±0.2° was 0.68°, and also no clear peak was seen at 11.5°±0.2°.

Figure 17:
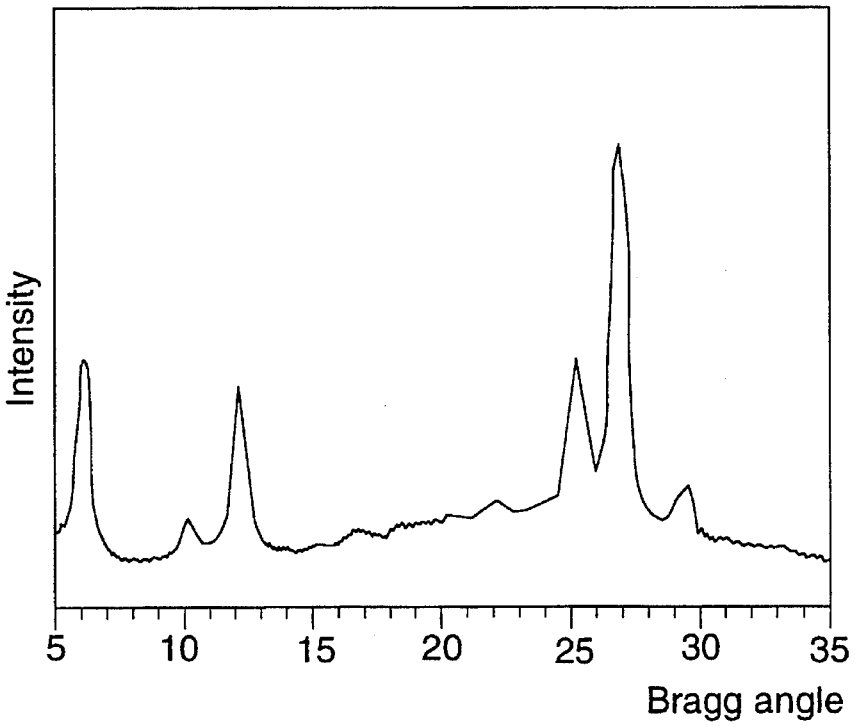
FIG. 17 is an X-ray diffraction spectrum of the compound outside the scope of the present invention.

This X-ray diffraction spectrum is shown in FIG. 17.

Production of photoreceptor 2-12:

A photoreceptor 2-12 (Comparative Example 10-3) as shown in Table 9 was produced in the same manner as the production of photoreceptor 2-1 except that the conductive support comprised of the untreated aluminum pipe as used in photoreceptor 2-1 was made to have a ten-point surface roughness Rz of 0.12 in place of 0.25.

Production of photoreceptor 2-13:

A photoreceptor 2-13 (Comparative Example 10-4) as shown in Table 9 was produced in the same manner as the production of photoreceptor 2-1 except that the conductive support comprised of the untreated aluminum pipe as used in photoreceptor 2-1 was made to have a ten-point surface roughness Rz of 1.60 in place of 0.25

Production of photoreceptor 2-14:

A photoreceptor 2-14 (Example 16-10) as shown in Table 9 was produced in the same manner as the production of photoreceptor 2-2 except that the carrier transportation material used in the photoreceptor 2-2 was replaced with C-5.

Production of photoreceptor 2-15:

A photoreceptor 2-15 (Example 16-11) as shown in Table 9 was produced in the same manner as the production of photoreceptor 2-2 except that the carrier transportation material used in the photoreceptor 2-2 was replaced with D-4.

Production of photoreceptor 2-16:

A photoreceptor 2-16 (Example 16-12) as shown in Table 9 was produced in the same manner as the production of photoreceptor 2-2 except that the carrier transportation material used in the photoreceptor 2-2 was replaced with E-7.

C-5

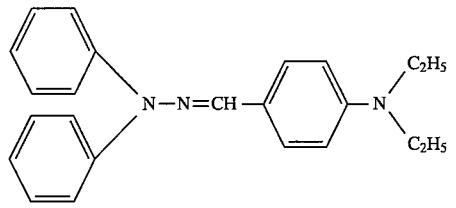

-continued

D-4

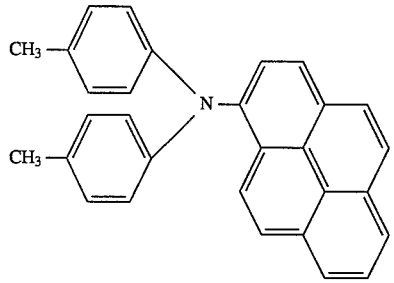

E-7

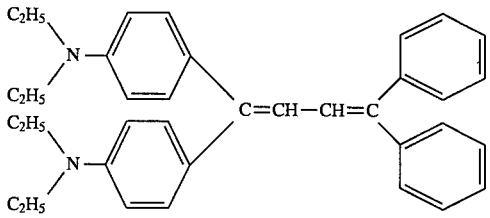

TABLE 8A

| Dispersion No. | X-ray dif. spectrum | CGM crystal form characteristics | | |
|---|---|---|---|---|
| | | Peak at 11.5° | Maximum peak | Half width (12.4°) |
| 1 | FIG. 4 | None | 12.4° | 0.86° |
| 2 | — | None | 12.4° | 0.94° |
| 3 | — | None | 12.4° | 0.68° |
| 4 | — | Seen | 12.4° | 0.60° |
| 5 | FIG. 5 | None | 27.1° | 0.68° |

TABLE 8B

| Dispersion No. | Dispersion conditions | | |
|---|---|---|---|
| | Carrier generation material | Solvent | Dispersing |
| 1 | AP product of A-1 | Methyl ethyl ketone | SG; Beads: 2,000 g; for 15 hrs |
| 2 | AP product of A-1 | 1,2-Dichloroethane | SG; Beads: 2,500 g; for 10 hrs |
| 3 | AP product of A-1 | Tetrahydrofuran | SG; Beads: 1,500 g; for 10 hrs |
| 4 | AP product of A-1 | Methyl ethyl ketone | US dispersion; for 5 hrs |
| 5 | SUB product of A-1 | Methyl ethyl ketone | SG; Beads: 2,000 g; for 15 hrs |

TABLE 9

| Photo-receptor No. | Disper-sion No. | CTM | Intermediate layer resin (Layer thickness/μm) | Support surface roughness Rz |
|---|---|---|---|---|
| 2-1 | 1 | T-1 | CM-8000 (0.2) | 0.25 |
| 2-2 | 1 | T-1 | CM-8000 (0.2) | 0.80 |
| 2-3 | 1 | T-1 | CM-8000 (0.2) | 1.45 |
| 2-4 | 2 | T-1 | CM-8000 (0.2) | 0.80 |
| 2-5 | 3 | T-1 | CM-8000 (0.2) | 0.80 |
| 2-6 | 1 | T-1 | LUCKAMIDE 5003 (0.2) | 0.80 |
| 2-7 | 1 | T-2 | CM-8000 (0.2) | 0.80 |
| 2-8 | 1 | T-2 | CM-8000 (0.4) | 0.80 |
| 2-9 | 1 | T-2 | CM-8000 (0.05) | 0.80 |
| 2-10 | 4 | T-2 | CM-8000 (0.2) | 0.80 |
| 2-11 | 5 | T-2 | CM-8000 (0.2) | 0.80 |
| 2-12 | 1 | T-1 | CM-8000 (0.2) | 0.12 |
| 2-13 | 1 | T-1 | CM-8000 (0.2) | 1.60 |
| 2-14 | 1 | C-5 | CM-8000 (0.2) | 0.80 |
| 2-15 | 1 | D-4 | CM-8000 (0.2) | 0.80 |
| 2-16 | 1 | E-7 | CM-8000 (0.2) | 0.80 |

Actual copy test:

The sixteen kinds of photoreceptors No. 2-1 to No. 2-2 were each incorporated in a digital copying machine KONICA 9028 (trade name; manufactured by Konica Corporation), and actual running tests were made by copying 100,000 times according to a reverse development system to examine image quality (interference fringes, black dots and fog) on the first copying and the 100,000th copying.

Results obtained are shown in Table 10.

TABLE 10(A)

| | Photo-receptor No. | Image quality | | | | | |
|---|---|---|---|---|---|---|---|
| | | Initial stage | | | 100,000th copying | | |
| | | Inter-ference fringes | Black dots | Fog | Inter-ference fringes | Black dots | Fog |
| Example: | | | | | | | |
| 16-1 | 2-1 | None | A | A | None | A | A |
| 16-2 | 2-2 | None | A | A | None | A | A |

TABLE 10(A)-continued

| | | Image quality | | | | | |
|---|---|---|---|---|---|---|---|
| | | Initial stage | | | 100,000th copying | | |
| | Photo-receptor No. | Inter-ference fringes | Black dots | Fog | Inter-ference fringes | Black dots | Fog |
| 16-3 | 2-3 | None | A | A | None | A | A |
| 16-4 | 2-4 | None | A | A | None | A | A |
| 16-5 | 2-5 | None | A | A | None | A | A |
| 16-6 | 2-6 | None | A | A | None | A | A |
| 16-7 | 2-7 | None | A | A | None | A | A |
| 16-8 | 2-8 | None | A | A | None | A | A |
| 16-9 | 2-9 | None | A | A | None | A | A |
| Comparative Example: | | | | | | | |
| 10-1 | 2-10 | None | A | C | None | A | C |
| 10-2 | 2-11 | None | A | C | None | A | C |
| 10-3 | 2-12 | Seen | A | A | Seen | A | A |
| 10-4 | 2-13 | Seen | C | B | Seen | C | B |
| Example: | | | | | | | |
| 16-10 | 2-14 | None | A | A | None | A | A |
| 16-11 | 2-15 | None | A | A | None | A | A |
| 16-12 | 2-16 | None | A | A | None | A | A |

TABLE 10(B)

| | Potential characteristics | | | | | |
|---|---|---|---|---|---|---|
| | Initial stage | | | 100,000th copying | | |
| | VH (−V) | VL (−V) | Vr (−V) | VH (−V) | VL (−V) | Vr (−V) |
| Example: | | | | | | |
| 16-1 | 854 | 51 | 12 | 848 | 81 | 24 |
| 16-2 | 850 | 50 | 15 | 848 | 82 | 24 |
| 16-3 | 848 | 52 | 13 | 847 | 79 | 22 |
| 16-4 | 851 | 51 | 12 | 846 | 83 | 26 |
| 16-5 | 845 | 56 | 19 | 838 | 88 | 30 |
| 16-6 | 850 | 52 | 14 | 848 | 80 | 23 |
| 16-7 | 582 | 45 | 9 | 848 | 67 | 15 |
| 16-8 | 850 | 50 | 14 | 846 | 83 | 25 |
| 16-9 | 851 | 43 | 10 | 844 | 65 | 16 |
| Comparative Example: | | | | | | |
| 10-1 | 830 | 163 | 72 | 852 | 269 | 146 |
| 10-2 | 832 | 182 | 78 | 860 | 328 | 172 |
| 10-3 | 853 | 50 | 13 | 849 | 80 | 24 |
| 10-4 | 847 | 52 | 12 | 845 | 78 | 21 |
| Example: | | | | | | |
| 16-10 | 850 | 70 | 25 | 848 | 97 | 41 |
| 16-11 | 852 | 25 | 30 | 850 | 100 | 35 |
| 16-12 | 850 | 60 | 16 | 847 | 90 | 30 |

Manner of image quality evaluation (1) Interference fringes:

A halftone chart was actually copied to visually judge whether interference fringes were "None" or "Seen".

(2) Black dots:

A white paper chart was actually copied on A4-size plain paper, and the diameters and number of black dots were measured using an image analyzer OMNICON 3000 TYPE (trade name, manufactured by Shimadzu Corporation) to make evaluation according to the criteria as shown in Table 11 below.

TABLE 11

| Evaluation | Criteria |
|---|---|
| A | No black dots of 0.05 mm or larger diameters are seen. |
| B | Per square centimeter, 1 to 10 black dots of 0.05 mm or larger diameters are seen. |
| C | Per square centimeter, 11 or more black dots of 0.05 mm or larger diameters are seen. |

(3) Fog:

Fog densities were read on Macbeth Densitometer RD-914 (manufactured by Macbeth Co.) to make evaluation according to the criteria as shown in Table 12 below.

TABLE 12

| Evaluation | Criteria |
|---|---|
| A | Image density is less than 0.05. |
| B | Image density is not less than 0.05 to less than 0.10. |
| C | Image density is not less than 0.10. |

In the above evaluation, those evaluated as "A" or "B" are of practical use, but "C", no practical use.

Potential characteristics test:

The above sixteen kinds of photoreceptors were each incorporated in a modified machine of the KONICA 9028 copying machine so modified as to have a surface potentiometer at the position of its developing assembly, and in the order as shown in Table 10 a process of from charging to exposure and up to charge elimination was repeated 100,000 times, where potential at unexposed areas ($V_H$), potential at exposed areas ($V_L$) and residual potential ($V_r$) were measured. The results were as shown in Table 10.

As is clear from Table 10, in the image forming tests made using the photoreceptors according to the present invention, the photoreceptors cause none of interference fringes, black dots and fog at the initial stage and in the tests of copying 100,000 times, showing a good image quality, and also in the potential characteristics test they show good results on all the $V_H$ $V_L$ and $V_r$. However, in the image forming tests made using the photoreceptors of Comparative Examples, the photoreceptors show poor results on some of the interference fringes, black dots and fog, and also in the potential characteristics test they show low $V_L$ and $V_r$, being of poor practical use.

As described above, the present invention makes it possible to produce an electrophotographic photoreceptor that may cause very less interference fringes even when laser beam sources are used, may cause no problems of blank areas, black dots, density decrease and fog and can promise a high productivity.

The present invention also makes it possible to produce an electrophotographic photoreceptor that may cause less problem on environmental pollution and less lowering of image quality and less deterioration of sensitivity even in its long-term use.

What is claimed is:

1. An electrophotographic photoreceptor comprising a carrier generation material selected from the group consisting of the following Formulas 1 and 2 having peaks at 2θ=6.3°, 12.4°, 25.3° and 27.1° in the Bragg angle (2θ±0.2°) as measured by X-ray diffraction under radiation of Cu-kα rays; said peak of 12.4° has a maximum intensity and has a half width of 0.65° or more; no peak being present at 11.5°; and a carrier transportation material selected from the group consisting of the following Formulas 3, 4, 5 and 6;

Formula 1:

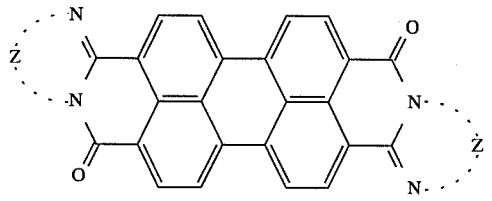

Formula 2:

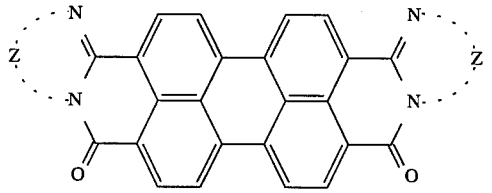

wherein Z represents an atomic group necessary to form a substituted or unsubstituted heterocyclic ring;

Formula 3:

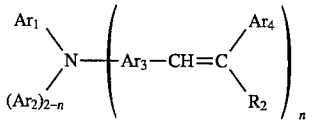

wherein $Ar_1$, $Ar_2$, $Ar_3$, and $Ar_4$ each represent a substituted or unsubstituted aromatic hydrocarbon group or heterocyclic group; $R_2$ is a hydrogen atom or a substituted or unsubstituted aromatic hydrocarbon group or heterocyclic group; n is 1 or 2; and $Ar_4$ and $R_2$ may combine with each other;

Formula 4:

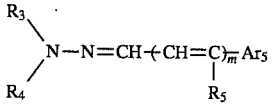

wherein $R_3$ and $R_4$ each represent a substituted or unsubstituted aromatic hydrocarbon group, heterocyclic group or alkyl group, which may combine with one another; $R_5$ is a substituted or unsubstituted aromatic hydrocarbon group, heterocyclic group or alkyl group, $Ar_5$ is a substituted or unsubstituted aromatic hydrocarbon group or heterocyclic group; and m is 0 or 1;

Formula 5:

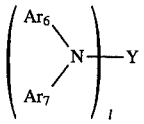

wherein Y is a substituted or unsubstituted benzene, naphthalene, pyrene, fluorene, carbazole or 4,4'-alkylidene diphenyl group; $Ar_6$ and $Ar_7$ each represent a substituted or unsubstituted aromatic hydrocarbon group or heterocyclic group, and l is 1 to 3;

Formula 6:

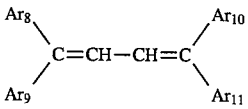

wherein $Ar_8$, $Ar_9$, $Ar_{10}$ and $Ar_{11}$ each represent a substituted or unsubstituted aromatic hydrocarbon group or heterocyclic group.

2. The electrophotographic photoreceptor of claim 1 comprising a conductive support and provided thereon an intermediate layer, a carrier generation layer, and a carrier transport layer, wherein the carrier generation layer contains said carrier generation material comprising a perylene pigment selected from the group consisting of Formulas 1 and 2, and the carrier transportation layer contains said carrier transportation material selected from the group consisting of Formulas 3, 4, 5 and 6.

3. The electrophotographic photoreceptor of claim 1, wherein said carrier generation material is a compound selected from the group consisting of the following Structural formulas 1 and 2:

Structural formula 1:

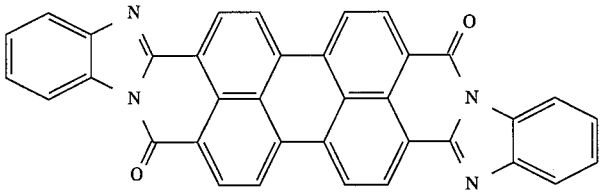

Structural formula 2:

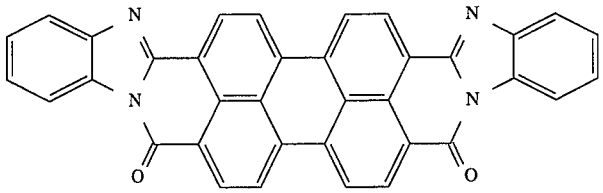

4. The electrophotographic photoreceptor of claim 2, wherein said perylene pigment is a compound selected from the group consisting of the following Structural formulas 1 and 2:

Structural formula 1:

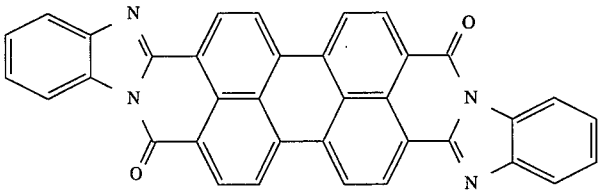

Structural formula 2:

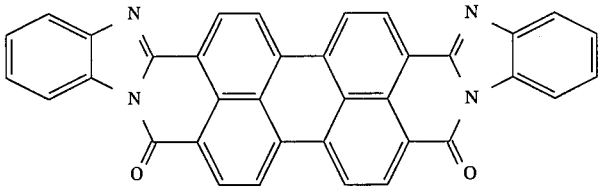

5. The electrophotographic photoreceptor of claim 2, wherein said perylene pigment is a compound selected from the group consisting of the following Structural formulas 1 and 2; and said carrier transportation material is a compound represented by Formula 3:

Structural formula 1:

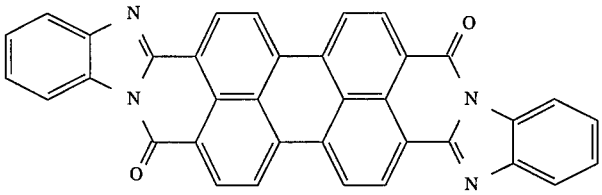

-continued

Structural formula 2:

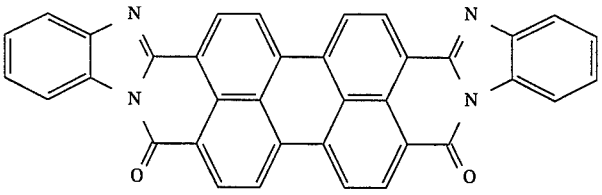

6. The electrophotographic photoreceptor of claim 2, wherein said perylene pigment is a compound selected from the group consisting of the following Structural formulas 1 and 2; and said carrier transportation material is a compound represented by Formula 4:

Structural formula 1:

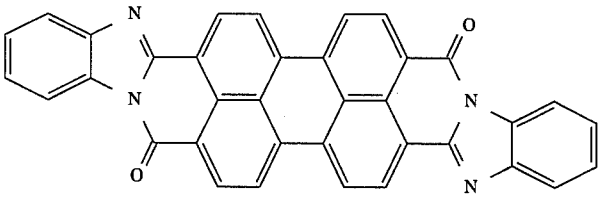

Structural formula 2:

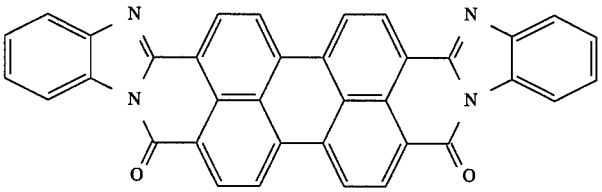

7. The electrophotographic photoreceptor of claim 2, wherein said perylene pigment is a compound selected from the group consisting of the following Structural formulas 1 and 2; and said carrier transportation material is a compound represented by Formula 5:

Structural formula 1:

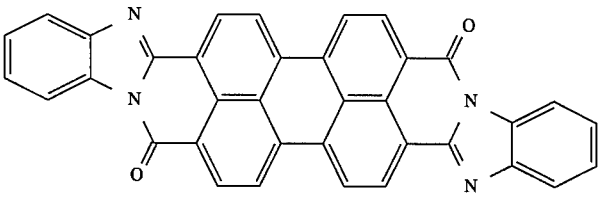

Structural formula 2:

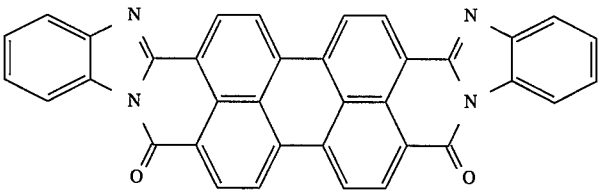

8. The electrophotographic photoreceptor of claim 2, wherein said perylene pigment is a compound selected from the group consisting of the following Structural formulas 1 and 2; and said carrier transportation material is a compound represented by Formula 6:

Structural formula 1:

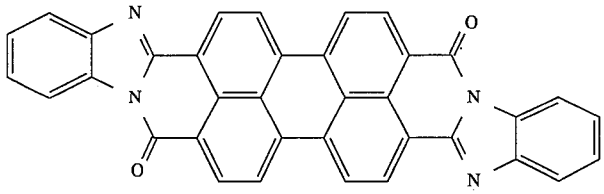

Structural formula 2:

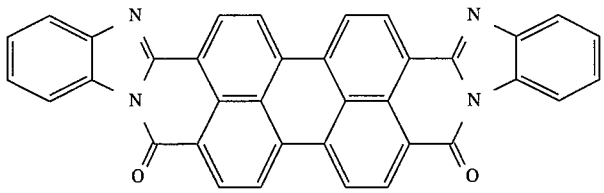

9. The electrophotographic photoreceptor of claim 2, wherein said perylene pigment is purified by sublimation purification and is treated with acid paste treatment.

10. The electrophotographic photoreceptor of claim 2, wherein said intermediate layer is provided on said support layer, said carrier generation layer is provided on said intermediate layer, and said carrier transportation layer is provided on said carrier generation layer; said intermediate layer contains an alcohol-soluble polyamide resin, and said carrier generation layer is formed by using a dispersion comprising said perylene pigment, a polymeric binder resin and an organic solvent.

11. The electrophotographic photoreceptor of claim 10, wherein said organic solvent is a ketone type solvent and said polymeric binder resin is a polyvinyl butyral resin.

12. The electrophotographic photoreceptor of claim 2, wherein said conductive support has a rough surface, said intermediate layer is provided on said conductive support, said carrier generation layer is provided on said intermediate layer, and said carrier transportation layer is provided on said carrier generation layer; said conductive support comprises an aluminum base material having a base material surface roughness, wherein a parallel line depth Rp is within the range of 0.11 μm to 0.8 μm and a maximum height of a roughness curve Rmax is within the range of 0.2 μm to 1.6 μm.

13. The electrophotographic photoreceptor of claim 12, wherein said intermediate layer comprising polyamide resin, is provided between said conductive support and said carrier generation layer.

14. The electrophotographic photoreceptor of claim 2, wherein said conductive support has a ten-point average surface roughness Rz of not less than 0.20 μm and not more than 1.50 μm.

15. The electrophotographic photoreceptor of claim 14, wherein an intermediate layer comprising a polyamide resin is provided between said conductive support and said carrier generation layer.

16. The electrophotographic photoreceptor of claim 1 wherein the heterocyclic ring containing Z is an unsubstituted or substituted benzene ring, a naphthalene ring, an anthracene ring, a phenanthrene ring, a pyridine ring, a pyrimidine ring, a pyrazole ring, or a anthraquinone ring, the substituents being selected from the group consisting of at least one halogen atom, an alkyl, alkoxy, aryl, aryloxy, acyl, acyloxy, amino, carbamoyl, nitro, and cyano group.

17. The electrophotographic photoreceptor of claim 1 wherein the aromatic hydrocarbon group or heterocyclic group of Formula 3 is unsubstituted or substituted benzene, naphthalene, anthracene, thiophene, pyridine, or carbazole, the substituents being selected from the group consisting of at least one halogen atom, alkyl, aryl, alkyloxy, aryloxy, acyl, acyloxy, amino, and cyano group.

18. The electrophotographic photoreceptor of claim 1 wherein in Formula 4, $R_3$ and $R_4$ are selected from the group consisting of a methyl, ethyl, phenyl, naphthyl, and a thienylmethyl group, $R_5$ is a hydrogen atom or a phenyl group, and $Ar_5$ is a benzene, naphthalene, anthracene, thiophene, pyridine, or carbazole group.

19. The electrophotographic photoreceptor of claim 1 wherein in Formula 5, Y is a $C_1$–$C_6$ alkyl radical, $Ar_6$ and $Ar_7$ are a benzene radical substituted or unsubstituted with a $C_1$–$C_6$ alkyl radical, an aryl radical, an alkoxy radical, or an aryloxy radical.

20. The electrophotographic photoreceptor of claim 1 wherein the substituents in Formula 6 are dialkylamino or diarylamino.

* * * * *